US006726520B2

(12) United States Patent
Takeda et al.

(10) Patent No.: US 6,726,520 B2
(45) Date of Patent: Apr. 27, 2004

(54) APPARATUS FOR PRODUCING ELECTRON SOURCE

(75) Inventors: Toshihiko Takeda, Kanagawa (JP); Masaru Kamio, Kanagawa (JP); Masataka Yamashita, Kanagawa (JP); Yasue Sato, Tokyo (JP); Hitoshi Oda, Kanagawa (JP); Keisuke Yamamoto, Kanagawa (JP); Miki Tamura, Kanagawa (JP); Hideshi Kawasaki, Tokyo (JP); Kazuhiro Jindai, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 158 days.

(21) Appl. No.: 09/788,411

(22) Filed: Feb. 21, 2001

(65) Prior Publication Data

US 2001/0036682 A1 Nov. 1, 2001

Related U.S. Application Data

(63) Continuation of application No. PCT/JP99/04835, filed on Sep. 7, 1999.

(30) Foreign Application Priority Data

| | | |
|---|---|---|
| Sep. 7, 1998 | (JP) | 10-253037 |
| Feb. 25, 1999 | (JP) | 11-047805 |
| Feb. 25, 1999 | (JP) | 11-048134 |
| Sep. 1, 1999 | (JP) | 11-247930 |

(51) Int. Cl.[7] ..... H01B 9/02

(52) U.S. Cl. ..... 445/62; 445/6

(58) Field of Search ..... 445/3, 6, 24, 62, 445/73

(56) References Cited

U.S. PATENT DOCUMENTS

| | | | | |
|---|---|---|---|---|
| 5,578,906 | A | 11/1996 | Smith | 315/169.3 |
| 5,591,061 | A * | 1/1997 | Ikeda et al. | 445/3 |
| 5,622,634 | A | 4/1997 | Noma et al. | 216/40 |
| 6,147,449 | A | 11/2000 | Iwasaki et al. | 313/495 |
| 6,169,356 | B1 | 1/2001 | Ohnishi et al. | 313/495 |
| 6,171,162 | B1 | 1/2001 | Iwasaki et al. | 445/6 |
| 6,184,610 | B1 | 2/2001 | Shibata et al. | 313/309 |

FOREIGN PATENT DOCUMENTS

| | | | |
|---|---|---|---|
| JP | 05-114644 | 5/1993 | |
| JP | 7-235255 | 9/1995 | |
| JP | 8-7749 | 1/1996 | |
| JP | 08-007749 | 1/1996 | H01J/9/02 |
| JP | 08-045416 | 2/1996 | |
| JP | 8-171849 | 7/1996 | |
| JP | 09-293469 | 11/1997 | |
| JP | 09-330653 | 12/1997 | |
| KR | 1996-0039066 | 11/1996 | H01J/17/12 |

* cited by examiner

*Primary Examiner*—Kenneth J. Ramsey
(74) *Attorney, Agent, or Firm*—Fitzpatrick, Cella, Harper & Scinto

(57) ABSTRACT

This invention provides an electron source manufacturing apparatus which can be easily downsized and operated. The electron source manufacturing apparatus includes a support member for supporting a substrate (10) having a conductor (11), a vessel (12) which has a gas inlet port (15) and a gas exhaust port (16) and covers a partial region of the surface of the substrate (10); a gas inlet unit (24) connected to the gas inlet port (15) to introduce gas into the vessel, an exhaust unit (26) connected to the gas exhaust port to evacuate the interior of the vessel, and a voltage application unit (32) for applying a voltage to the conductor.

15 Claims, 25 Drawing Sheets

APPARATUS FOR PRODUCING ELECTRON SOURCE

This application is a continuation of International Application No. PCT/JP99/04835, filed Sep. 7, 1999, published in Japanese on Mar. 16, 2000 as publication no. WO00/14761, which claims the benefit of Japanese Patent Application No. 10-253037, filed Sep. 7, 1998, Japanese Patent Application No. 11-048134, filed Feb. 25, 1999, Japanese Patent Application No. 11-047805, filed Feb. 25, 1999, and Japanese Patent Application No. 11-247930, filed Sep. 1, 1999.

TECHNICAL FIELD

The present invention relates to an electron source manufacturing apparatus and manufacturing method.

BACKGROUND ART

Conventionally, two types of devices, namely thermionic electron-emitting devices and cold cathode electron-emitting devices, are known as electron-emitting devices. The cold cathode electron-emitting devices include field emission type electron-emitting devices, metal/insulator/metal type electron-emitting devices, and surface-conduction type electron-emitting devices.

The surface-conduction type electron-emitting device utilizes the phenomenon that electrons are emitted by flowing a current through a small-area thin film formed on a substrate, in parallel with the film surface. The present applicants have made many proposals for surface-conduction type electron-emitting devices having novel arrangements and their applications. The basic arrangement, manufacturing method, and the like are disclosed in, e.g., Japanese Patent Laid-Open Nos. 7-235255 and 8-171849.

The surface-conduction type electron-emitting device is characterized by comprising on a substrate a pair of facing device electrodes, and a conductive film which is connected to the pair of device electrodes and partially has an electron-emitting portion. Part of the conductive film is fissured.

A deposition film mainly containing at least either carbon or a carbon compound is formed at the end of the fissure.

A plurality of electron-emitting devices can be arranged on a substrate, and wired to fabricate an electron source having a plurality of surface-conduction type electron-emitting devices.

The display panel of an image forming apparatus can be formed by combining this electron source and fluorescent substances.

The panel of the electron source is conventionally manufactured as follows.

As the first manufacturing method, an electron source substrate is fabricated on which a plurality of devices, each made up of a conductive film and a pair of device electrodes connected to the conductive film, and wiring lines connecting the plurality of devices are formed. The fabricated electron source substrate is set in a vacuum chamber. After the interior of the vacuum chamber is evacuated, a voltage is applied to each device via external terminals to form a fissure in the conductive film of each device. Gas containing an organic substance is introduced into the vacuum chamber. A voltage is applied again to each device via external terminals in the atmosphere in which the organic substance exists, thereby depositing carbon or a carbon compound near the fissure.

As the second manufacturing method, an electron source substrate is fabricated on which a plurality of devices, each made up of a conductive film and a pair of device electrodes connected to the conductive film, and wiring lines connecting the plurality of devices are formed on the substrate. The fabricated electron source substrate and a substrate having fluorescent substances are joined via a support frame to fabricate the panel of an image forming apparatus. The interior of the panel is evacuated via the exhaust pipe of the panel, and a voltage is applied to each device via external terminals of the panel to form a fissure in the conductive film of each device. Gas containing an organic substance is introduced into the panel via the exhaust pipe. A voltage is applied again to each device via external terminals in the atmosphere in which the organic substance exists, thereby depositing carbon or a carbon compound near the fissure.

These manufacturing methods have been adopted. However, the first manufacturing method requires a larger vacuum chamber and an exhaust device coping with a high vacuum as the size of the electron source substrate increases. The second manufacturing method requires a long time for evacuation from the inner space of the panel of the image forming apparatus and introduction of gas containing an organic substrate into the inner space of the panel.

DISCLOSURE OF INVENTION

It is an object of the present invention to provide an electron source manufacturing apparatus which can be easily downsized and operated.

It is another object of the present invention to provide an electron source manufacturing method which increases the manufacturing speed and is suitable for mass productivity.

It is still another object of the present invention to provide an electron source manufacturing apparatus and manufacturing method capable of manufacturing an electron source excellent in electron emission characteristics.

An electron source manufacturing apparatus according to the present invention is characterized by comprising a support for supporting a substrate having a conductor, a vessel which has a gas inlet port and a gas exhaust port and covers a partial region of a surface of the substrate, means, connected to the gas inlet port, for introducing gas into the vessel, means, connected to the gas exhaust port, for evacuating an interior of the vessel, and means for applying a voltage to the conductor.

According to an electron source manufacturing apparatus of the present invention, the support in the above electron source manufacturing apparatus comprises means for fixing the substrate to the support.

According to an electron source manufacturing apparatus of the present invention, the support in the above electron source manufacturing apparatus comprises means for vacuum-chucking the substrate and the support.

According to an electron source manufacturing apparatus of the present invention, the support in the above electron source manufacturing apparatus comprises means for electrostatically chucking the substrate and the support.

According to an electron source manufacturing apparatus of the present invention, the support in the above electron source manufacturing apparatus comprises a heat conduction member.

According to an electron source manufacturing apparatus of the present invention, the support in the above electron source manufacturing apparatus comprises a temperature control mechanism for the substrate.

According to an electron source manufacturing apparatus of the present invention, the support in the above electron source manufacturing apparatus comprises heat generation means.

According to an electron source manufacturing apparatus of the present invention, the support in the above electron source manufacturing apparatus comprises cooling means.

According to an electron source manufacturing apparatus of the present invention, the vessel in the above electron source manufacturing apparatus comprises means for diffusing gas introduced into the vessel.

According to an electron source manufacturing apparatus of the present invention, the above electron source manufacturing apparatus further comprises means for heating the introduced gas.

According to an electron source manufacturing apparatus of the present invention, the above electron source manufacturing apparatus further comprises means for dehumidifying the introduced gas.

An electron source manufacturing method according to the present invention is characterized by comprising the steps of arranging a substrate having a conductor and a wiring line connected to the conductor, on a support, covering the conductor on the substrate with a vessel except for part of the wiring line, setting a desired atmosphere in the vessel, and applying a voltage to the conductor via the part of the wiring line.

According to an electron source manufacturing method of the present invention, the step of setting the desired atmosphere in the vessel in the above electron source manufacturing method comprises the step of evacuating an interior of the vessel.

According to an electron source manufacturing method of the present invention, the step of setting the desired atmosphere in the vessel in the above electron source manufacturing method comprises the step of introducing gas into the vessel.

According to an electron source manufacturing method of the present invention, the above electron source manufacturing method further comprises the step of fixing the substrate to the support.

According to an electron source manufacturing method of the present invention, the step of fixing the substrate to the support in the above electron source manufacturing method comprises the step of vacuum-chucking the substrate and the support.

According to an electron source manufacturing method of the present invention, the step of fixing the substrate to the support in the above electron source manufacturing method comprises the step of electrostatically chucking the substrate and the support.

According to an electron source manufacturing method of the present invention, the step of arranging the substrate on the support in the above electron source manufacturing method comprises arranging a heat conduction member between the substrate and the support.

According to an electron source manufacturing method of the present invention, the step of applying the voltage to the conductor in the above electron source manufacturing method comprises the step of controlling a temperature of the substrate.

According to an electron source manufacturing method of the present invention, the step of applying the voltage to the conductor in the above electron source manufacturing method comprises the step of heating the substrate.

According to an electron source manufacturing method of the present invention, the step of applying the voltage to the conductor in the above electron source manufacturing method comprises the step of cooling the substrate.

An electron source manufacturing method according to the present invention is characterized by comprising the steps of arranging on a support a substrate on which a plurality of devices, each having a pair of electrodes and a conductive film arranged between the pair of electrodes, and wiring lines which connect the plurality of devices are formed, covering the plurality of devices on the substrate with a vessel except for part of the wiring lines, setting a desired atmosphere in the vessel, and applying a voltage to the plurality of devices via the part of the wiring lines.

An electron source manufacturing method according to the present invention is characterized by comprising the steps of arranging on a support a substrate on which a plurality of devices, each having a pair of electrodes and a conductive film arranged between the pair of electrodes, and a plurality of X-direction wiring lines and a plurality of Y-direction wiring lines which connect the plurality of devices in a matrix are formed, covering the plurality of devices on the substrate with a vessel except for part of the plurality of X-direction wiring lines and the plurality of Y-direction wiring lines, setting a desired atmosphere in the vessel, and applying a voltage to the plurality of devices via the part of the plurality of X-direction wiring lines and the plurality of Y-direction wiring lines.

According to an electron source manufacturing method of the present invention, the step of setting the desired atmosphere in the vessel in the above electron source manufacturing method comprises the step of evacuating an interior of the vessel.

According to an electron source manufacturing method of the present invention, the step of setting the desired atmosphere in the vessel in the above electron source manufacturing method comprises the step of introducing gas into the vessel.

According to an electron source manufacturing method of the present invention, the above electron source manufacturing method further comprises the step of fixing the substrate to the support.

According to an electron source manufacturing method of the present invention, the step of fixing the substrate to the support in the above electron source manufacturing method comprises the step of vacuum-chucking the substrate and the support.

According to an electron source manufacturing method of the present invention, the step of fixing the substrate to the support in the above electron source manufacturing method comprises the step of electrostatically chucking the substrate and the support.

According to an electron source manufacturing method of the present invention, the step of arranging the substrate on the support in the above electron source manufacturing method comprises arranging a heat conduction member between the substrate and the support.

According to an electron source manufacturing method of the present invention, the step of applying the voltage to the devices in the above electron source manufacturing method comprises the step of controlling a temperature of the substrate.

According to an electron source manufacturing method of the present invention, the step of applying the voltage to the devices in the above electron source manufacturing method comprises the step of heating the substrate.

According to an electron source manufacturing method of the present invention, the step of applying the voltage to the devices in the above electron source manufacturing method comprises the step of cooling the substrate.

An electron source manufacturing method according to the present invention is characterized by comprising the steps of arranging on a support a substrate on which a plurality of devices, each having a pair of electrodes and a conductive film arranged between the pair of electrodes, and wiring lines which connect the plurality of devices are formed, covering the plurality of devices on the substrate with a vessel except for part of the wiring lines, setting a first atmosphere in the vessel, applying a voltage to the plurality of devices via the part of the wiring lines in the first atmosphere, setting a second atmosphere in the vessel, and applying a voltage to the plurality of devices via the part of the wiring lines in the second atmosphere.

An electron source manufacturing method according to the present invention is characterized by comprising the steps of arranging on a support a substrate on which a plurality of devices, each having a pair of electrodes and a conductive film arranged between the pair of electrodes, and a plurality of X-direction wiring lines and a plurality of Y-direction wiring lines which connect the plurality of devices in a matrix are formed, covering the plurality of devices on the substrate with a vessel except for part of the plurality of X-direction wiring lines and the plurality of Y-direction wiring lines, setting a first atmosphere in the vessel, applying a voltage to the plurality of devices via the part of the plurality of X-direction wiring lines and the plurality of Y-direction wiring lines in the first atmosphere, setting a second atmosphere in the vessel, and applying a voltage to the plurality of devices via the part of the plurality of X-direction wiring lines and the plurality of Y-direction wiring lines in the second atmosphere.

According to an electron source manufacturing method of the present invention, the step of setting the first atmosphere in the vessel in the above electron source manufacturing method comprises the step of evacuating an interior of the vessel.

According to an electron source manufacturing method of the present invention, the step of setting the second atmosphere in the vessel in the above electron source manufacturing method comprises the step of introducing gas containing a carbon compound into the vessel.

According to an electron source manufacturing method of the present invention, the above electron source manufacturing method further comprises the step of fixing the substrate to the support.

According to an electron source manufacturing method of the present invention, the step of fixing the substrate to the support in the above electron source manufacturing method comprises the step of vacuum-chucking the substrate and the support.

According to an electron source manufacturing method of the present invention, the step of fixing the substrate to the support in the above electron source manufacturing method comprises the step of electrostatically chucking the substrate and the support.

According to an electron source manufacturing method of the present invention, the step of arranging the substrate on the support in the above electron source manufacturing method comprises arranging a heat conduction member between the substrate and the support.

According to an electron source manufacturing method of the present invention, the step of applying the voltage to the devices in the above electron source manufacturing method comprises the step of controlling a temperature of the substrate.

According to an electron source manufacturing method of the present invention, the step of applying the voltage to the devices in the above electron source manufacturing method comprises the step of heating the substrate.

According to an electron source manufacturing method of the present invention, the step of applying the voltage to the devices in the above electron source manufacturing method comprises the step of cooling the substrate.

A manufacturing apparatus according to the present invention comprises a support for supporting a substrate on which conductors are formed in advance, and a vessel which covers the substrate supported by the support. This vessel covers a partial region of the substrate surface. This allows forming an airtight space above the substrate while exposing, outside the vessel, part of wiring lines which are formed on the substrate to be connected to the conductors on the substrate. The vessel has a gas inlet port and gas exhaust port. The inlet port and exhaust port are respectively connected to means for introducing gas into the vessel and means for exhausting the gas in the vessel. This structure can set a desired atmosphere in the vessel. The substrate on which the conductors are formed in advance is a substrate which serves as an electron source by forming electron-emitting portions in the conductors by electrical processing. The manufacturing apparatus of the present invention also comprises means for performing electrical processing, e.g., means for applying a voltage to the conductors. This manufacturing apparatus can achieve downsizing, and easy operability of, e.g., electrical connection to a power source in electrical processing. In addition, the degree of freedom for the design such as the size and shape of the vessel can increase, and introduction of gas into the vessel and discharge of gas from the vessel can be performed within a short time.

In a manufacturing method according to the present invention, a substrate on which conductors and wiring lines connected to the conductors are formed in advance is arranged on a support. The conductors on the substrate are covered with a vessel except for part of the wiring lines. While part of the wiring lines formed on the substrate is exposed outside the vessel, the conductors are arranged in an airtight space formed above the substrate. The interior of the vessel is set to a desired atmosphere, and the conductors undergo electrical processing, e.g., receive a voltage via part of the wiring lines exposed outside the vessel. In this case, the desired atmosphere is a reduced-pressure atmosphere or an atmosphere in which a specific gas exists. Electrical processing is processing of forming electron-emitting portions in the conductors to obtain an electron source. In some cases, electrical processing is repeated a plurality of number of times in different atmospheres. For example, the conductors on the substrate are covered with the vessel except for part of the wiring lines. Then, the step of setting the first atmosphere in the vessel and performing electrical processing, and the step of setting the second atmosphere in the vessel and performing electrical processing are executed. Accordingly, high-quality electron-emitting portions are formed in the conductors to manufacture an electron source. As will be described later, the first and second atmospheres are preferably a reduced-pressure atmosphere, and an atmosphere in which a specific gas such as a carbon compound exists, respectively. This manufacturing method can facilitate electrical connection to a power source in electrical processing. Since the degree of freedom for the design such as the size and shape of the vessel can increase, introduction of gas into the vessel and discharge of gas from the vessel can be performed within a short time to increase the manufacturing speed. Moreover, this increases the reproducibility of electron emission characteristics of a manufactured electron source, and particularly the uniformity of electron emission characteristics of an electron source having a plurality of electron-emitting portions.

DETAILED DESCRIPTION OF THE PREFERRED EMBODIMENTS

The present invention will be described in more detail with reference to the accompanying drawings.

The first preferred embodiment of the present invention will be described.

Figure 1:
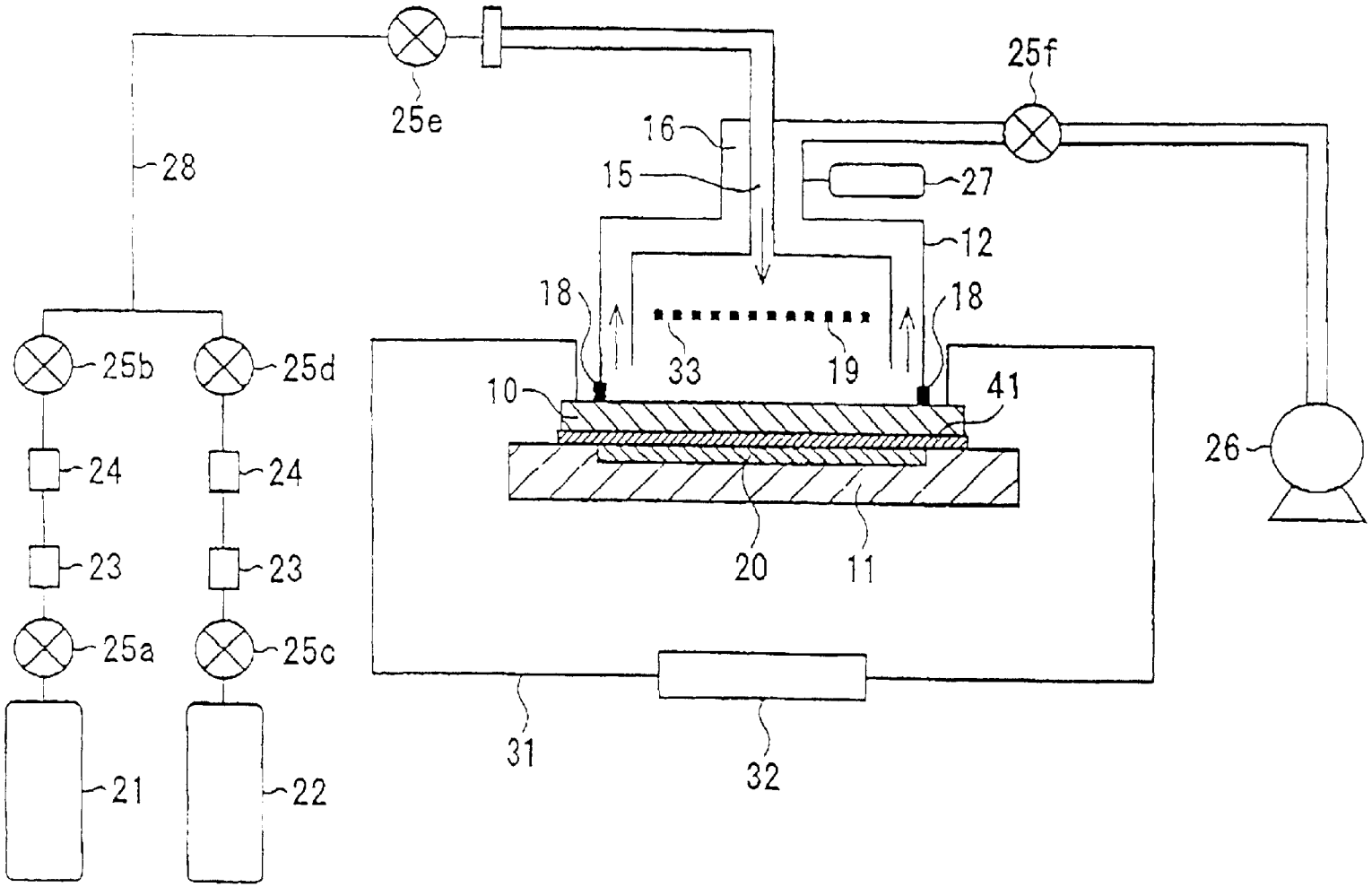
FIG. 1 is a sectional view showing the arrangement of an electron source manufacturing apparatus according to the present invention.
Figure 2:
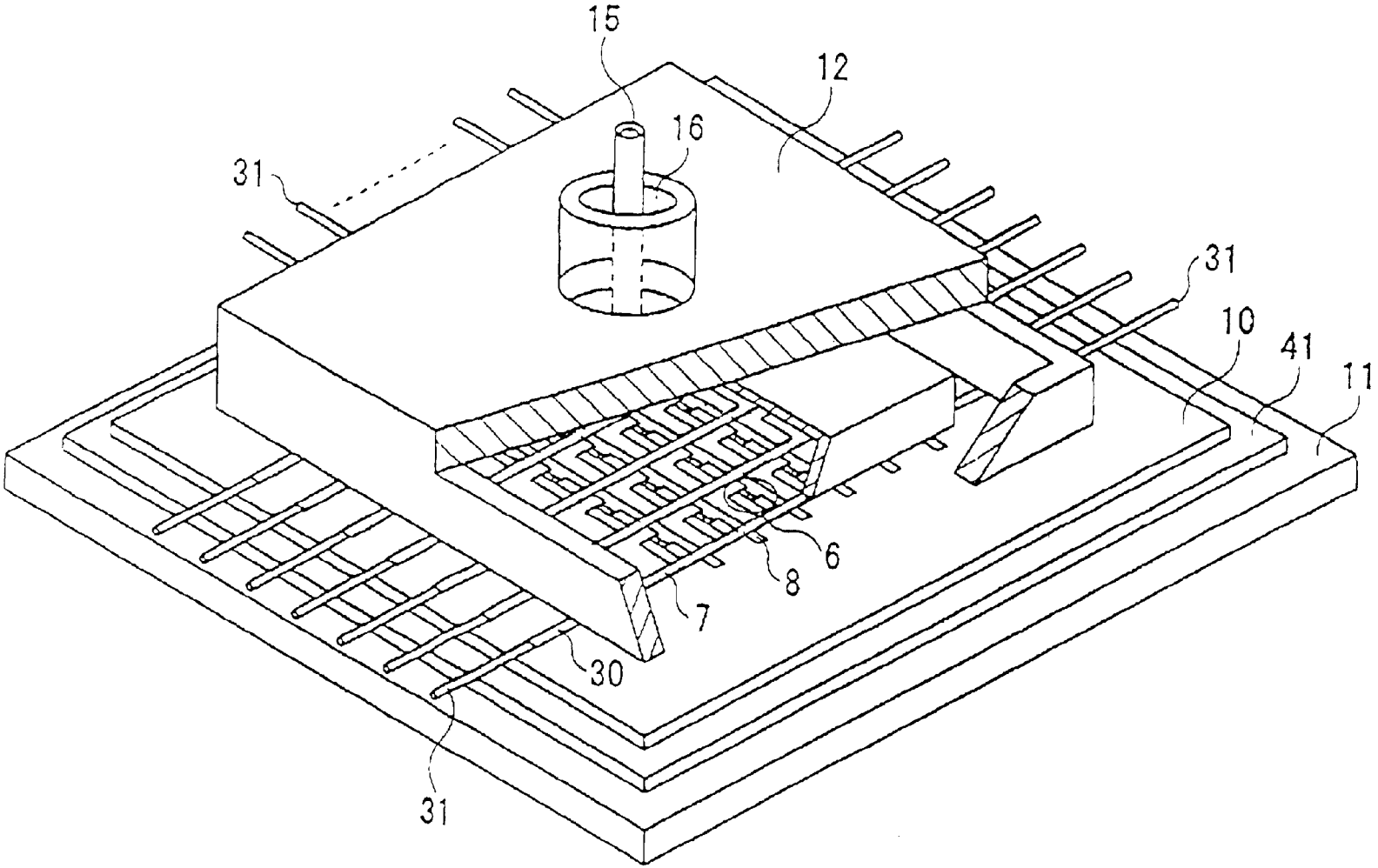
FIG. 2 is a partial cutaway perspective view showing the peripheral portion of an electron source substrate in FIGS. 1 and 3.
Figure 3:
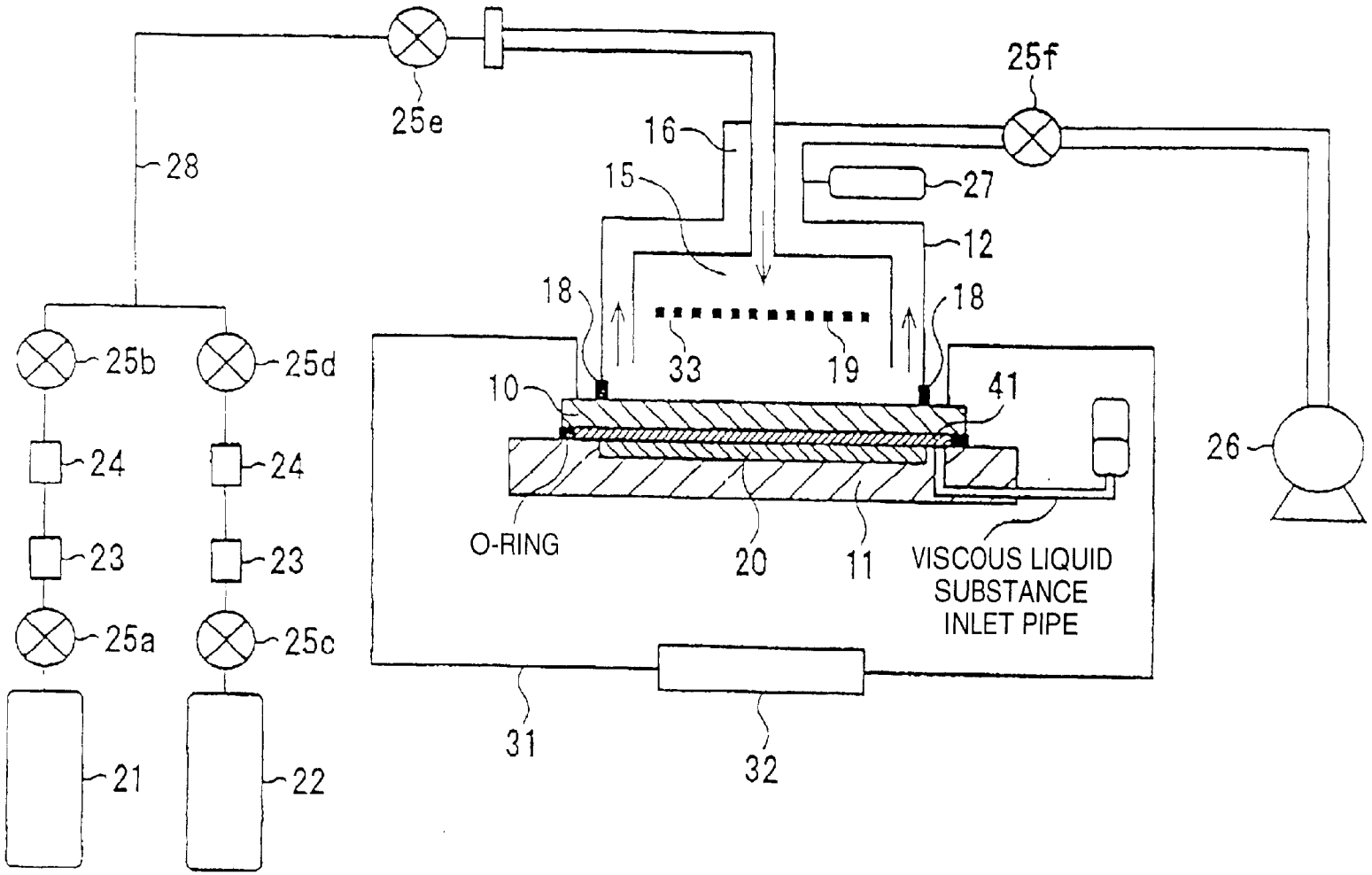
FIG. 3 is a sectional view showing another arrangement of the electron source manufacturing apparatus according to the present invention.

FIGS. 1, 2, and 3 show an electron source manufacturing apparatus according to this embodiment. FIGS. 1 and 3 are sectional views, and FIG. 2 is a perspective view showing the peripheral portion of an electron source substrate in FIG. 1. In FIGS. 1, 2, and 3, reference numeral 6 denotes a conductor serving as an electron-emitting device; 7, an X-direction wiring line; 8, a Y-direction wiring line; 10, an electron source substrate; 11, a support; 12, a vacuum vessel; 15, a gas inlet port; 16, an exhaust port; 18, a sealing member; 19, a diffusion plate; 20, a heater; 21, a hydrogen or organic substance gas; 22, a carrier gas; 23, a dehumidifying filter; 24, a gas flow controller; 25*a* to 25*f*, valves; 26, a vacuum pump; 27, a vacuum gauge; 28, a pipe; 30, an extracted wiring line; 32, a driver comprised of a power source and current control system; 31, a wiring line which connects the extracted wiring line 30 of the electron source substrate to the driver; 33, an opening of the diffusion plate 19; and 41, a heat conduction member.

The support 11 holds and fixes the electron source substrate 10, and has a mechanism of mechanically fixing the electron source substrate 10 with a vacuum chucking mechanism, electrostatic chucking mechanism, fixing jig, or the like. The support 11 incorporates the heater 20, and can heat the electron source substrate 10 via the heat conduction member 41, as needed.

The heat conduction member 41 is set on the support 11. The heat conduction member 41 may be sandwiched between the support 11 and the electron source substrate 10 or buried in the support 11 so as not to obstruct the mechanism of holding and fixing the electron source substrate 10.

The heat conduction member can absorb warpage and undulation of an electron source substrate, reliably transfer heat generated in the electrical processing step for the electron source substrate to the support or an auxiliary vacuum vessel (to be described later), and dissipate heat. The heat conduction member can prevent generation of cracks and damage to the electron source substrate, and contribute to an increase in yield.

By quickly, reliably dissipating heat generated in the electrical processing step, the heat conduction member 41 can contribute to reduction in an introduction gas concentration distribution caused by a temperature distribution, and reduction in nonuniformity of devices under the influence of a substrate heat distribution. This enables manufacturing an electron source excellent in uniformity.

The heat conduction member 41 can be made of a viscous liquid substance such as silicone grease, silicone oil, or gel substance. The heat conduction member 41 made of the viscous liquid substance may move on the support 11. In this case, to stay the viscous liquid substance at a predetermined position in a predetermined region on the support 11, i.e., under at least a region where the conductors 6 of the electron source substrate 10 are formed, a staying mechanism may be set on the support 11 in accordance with the region. The staying mechanism may be an O-ring or a member prepared by enclosing the viscous liquid substance in a heat-resistant bag as a closed heat conduction member.

When the viscous liquid substance is stayed by setting an O-ring or the like, but an air layer is formed between the O-ring and the substrate so as not to accurately contact each other, a method of forming an air vent or injecting the viscous liquid substance between the substrate and the support after setting the electron source substrate can also be employed. FIG. 3 is a schematic sectional view showing an apparatus having an O-ring and a viscous liquid substance inlet port in order to stay the viscous liquid substance in a predetermined region.

The heater 20 has a closed tubular shape in which a temperature control medium is sealed. Although not shown, if the apparatus adopts a mechanism of sandwiching the viscous liquid substance between the support 11 and the electron source substrate 10, and circulating the viscous liquid substance while controlling its temperature, the heater 20 is replaced by a heating means or cooling means for the electron source substrate 10. Further, the apparatus can adopt a mechanism which can control the temperature to a target temperature, and is comprised of a circulation type temperature control device, liquid medium, and the like.

Figure 15:
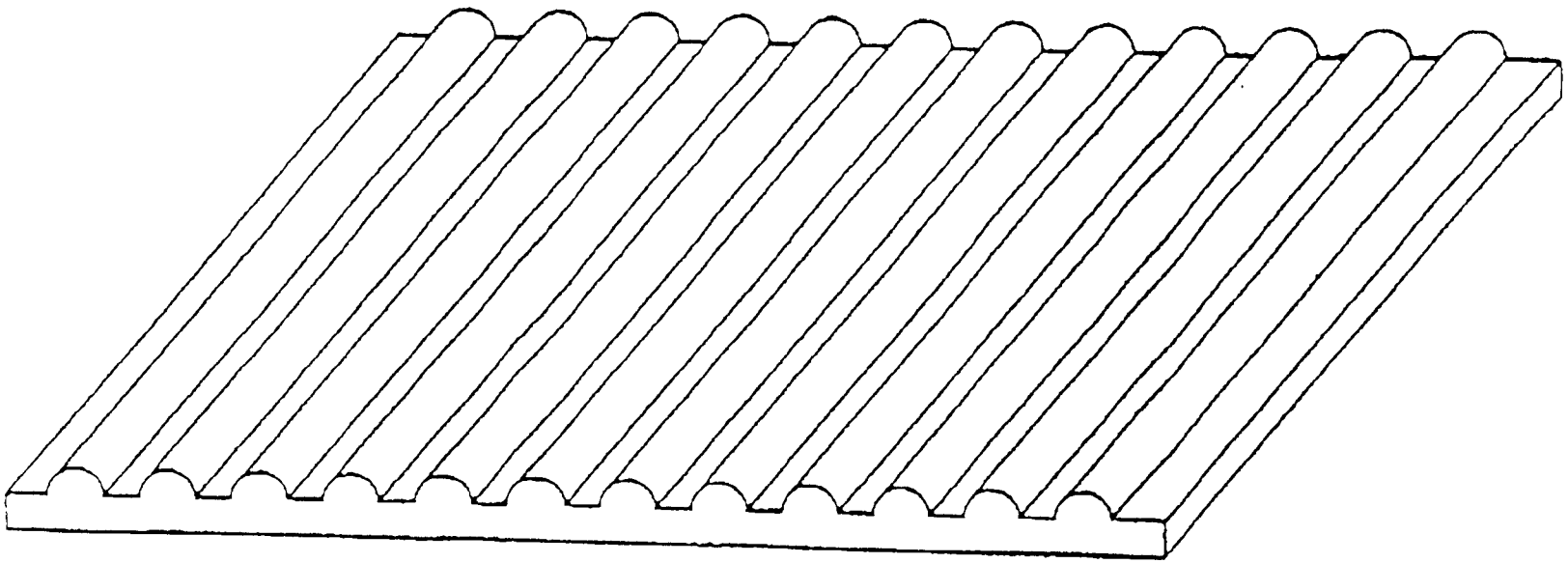
FIG. 15 is a perspective view showing the shape of a heat conduction member used in the electron source manufacturing apparatus according to the present invention.
Figure 16:
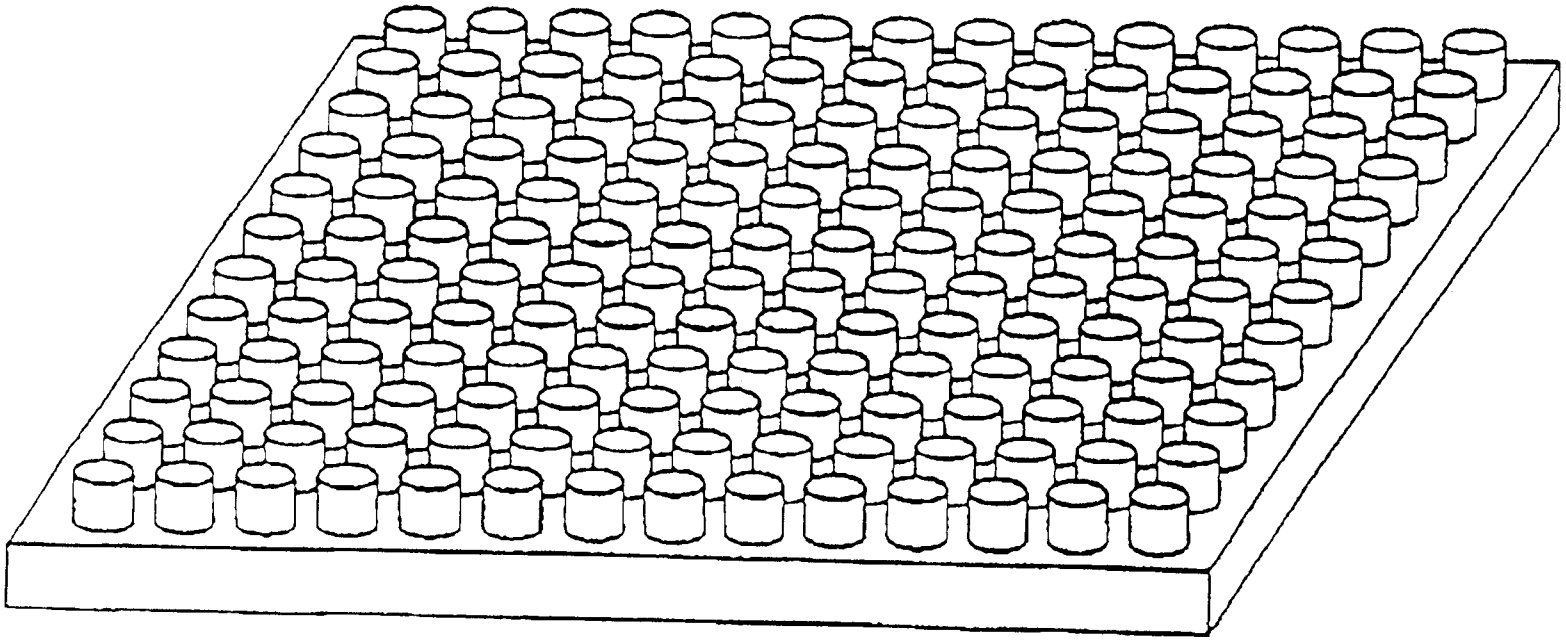
FIG. 16 is a perspective view showing another shape of the heat conduction member used in the electron source manufacturing apparatus according to the present invention.

The heat conduction member 41 may be an elastic member. The elastic member can be made of a synthetic resin material such as Teflon resin, a rubber material such as silicone rubber, a ceramic material such as alumina, or a metal material such as copper or aluminum. These materials may be used as sheets or divide sheets. Alternatively, as shown in FIGS. 15 and 16, columns such as circular cylinders or prisms, lines extending in the X-direction or Y-direction in accordance with the wiring lines of the electron source substrate, projections such as cones, spherical members such as spheres or rugby balls (elliptic spherical members), or spherical members having projections on their spherical surfaces may be set on the support.

Figure 17:
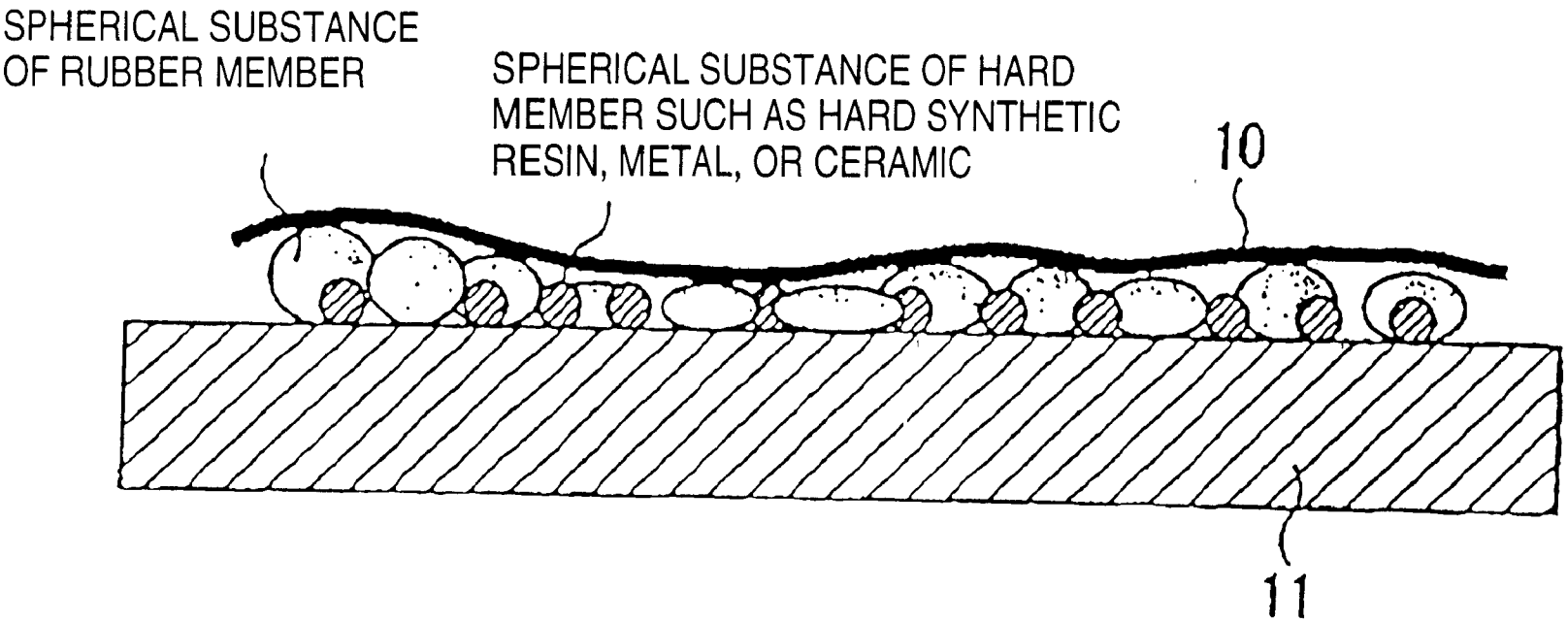
FIG. 17 is a sectional view showing the shape of a heat conduction member using a spherical rubber substance used in the electron source manufacturing apparatus according to the present invention.

FIG. 17 is a schematic view showing the structure of a spherical heat conduction member using a plurality of elastic members. In FIG. 17, the heat conduction member 41 is constituted by scattering and sandwiching, between the electron source substrate 10 and the support 11, a fine spherical substance such as a member of a rubber material which readily deforms, and a spherical substance (spherical substance which deforms less than the member of rubber material) smaller in diameter than the fine spherical member.

Figure 18:
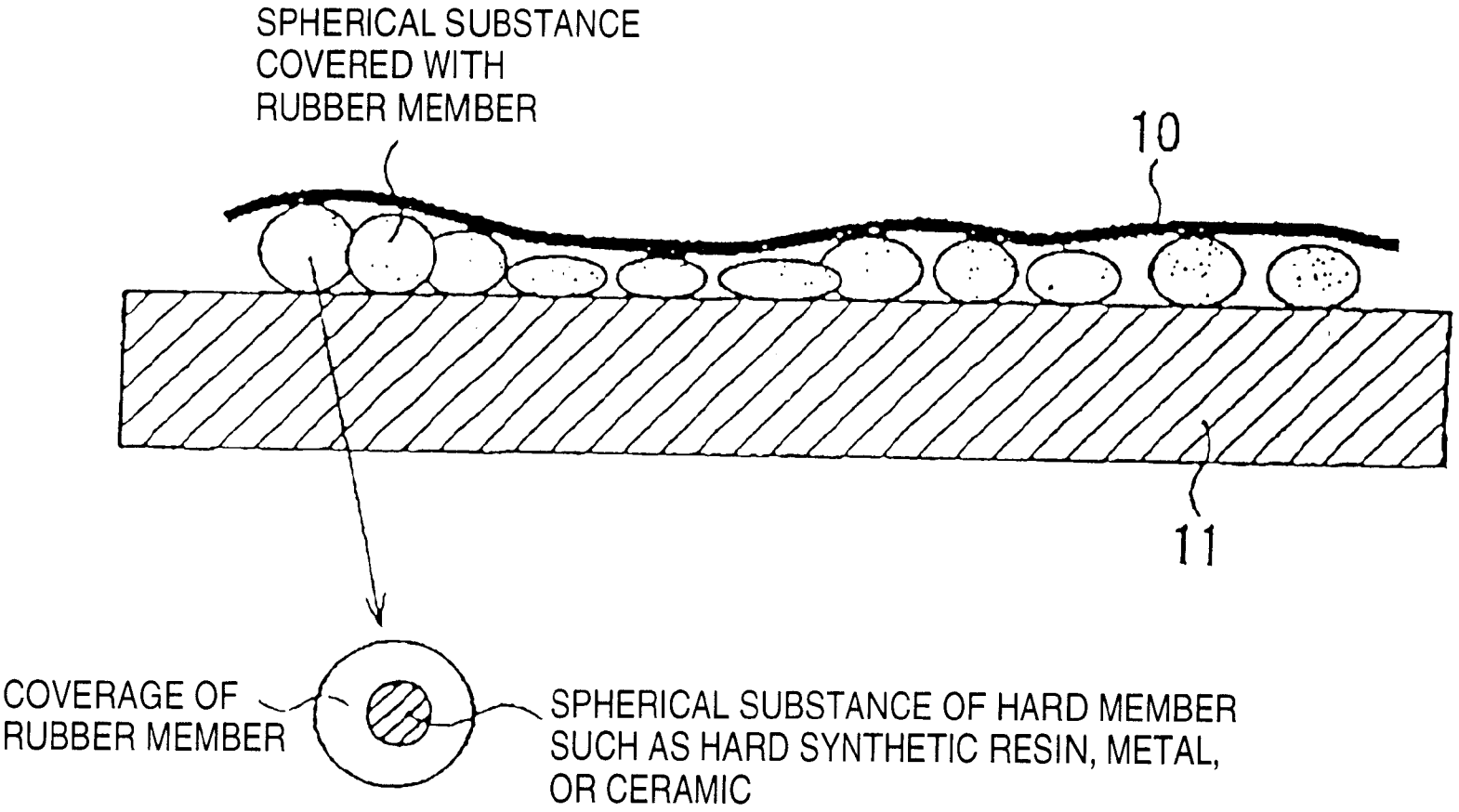
FIG. 18 is a sectional view showing another shape of the heat conduction member using the spherical rubber substance used in the electron source manufacturing apparatus according to the present invention.

FIG. 18 is a schematic view showing the structure of a heat conduction member using a composite material. The heat conduction member 41 is constituted by forming the central member from a hard member such as a ceramic member or metal member, and covering the spherical surface of the heat conduction member with a rubber member. In the use of a spherical substance which readily moves on the support 11, a staying mechanism as described for the use of the viscous liquid substance is desirably set on the support 11.

The elastic member may have a three-dimensional shape on a surface facing the electron source substrate. The three-dimensional shape is preferably, a columnar shape, linear shape, projecting shape, or spherical shape (hemispherical shape). More specifically, the three-dimensional shape is preferably a linear three-dimensional shape which substantially coincides with the positions of X-direction wiring lines or Y-direction wiring lines on the electron source substrate, as shown in FIG. 15, a columnar three-dimensional shape which substantially coincides with the positions of device electrodes, as shown in FIG. 16, or although not shown, a hemispherical three-dimensional shape.

The vacuum vessel 12 is a glass or stainless steel vessel, and is preferably made of a material which hardly discharges gas from the vessel. The vacuum vessel 12 has a structure which covers a region where the conductors 6 are formed, except for the extracted wiring lines of the electron source substrate 10, and can resist at least a pressure range of $1.33\times10^{-1}$ Pa ($1\times10^{-3}$ Torr) to the atmospheric pressure.

The sealing member 18 holds an airtight space between the electron source substrate 10 and the vacuum vessel 12, and is an O-ring, rubber sheet, or the like.

The organic substance gas 21 is an organic substance used in activation of an electron-emitting device (to be described later), or a gas mixture prepared by diluting an organic substance with nitrogen, helium, argon, or the like. In performing forming electrification processing (to be described later), gas for prompting formation of a fissure in the conductive film, e.g., a reducing hydrogen gas may be introduced into the vacuum vessel 12. In introducing gas in another step, the gas can be used by connecting the vacuum vessel 12 to the pipe 28 using an inlet pipe and the valve member 25*e*.

The organic substance used to activate the electron-emitting device includes aliphatic hydrocarbons such as alkane, alkene, and alkyne, aromatic hydrocarbons, alcohols, aldehydes, ketones, amines, nitrites, phenol, and organic acids such as carboxylic and sulfonic acids. Detailed examples are saturated hydrocarbons given by $C_nH_{2n+2}$ such as methane, ethane, and propane, unsaturated hydrocarbons given by $C_nH_{2n}$ and the like such as ethylene and propylene, benzene, toluene, methanol, ethanol, acetaldehyde, acetone, methyl ethyl ketone, methyl amine, ethyl amine, phenol, benzonitrile, and acetonitrile.

When the organic substance is gaseous at room temperature, the organic substance gas 21 can be directly used. When the organic substance is liquid or solid at room temperature, it is evaporated or sublimated in the vessel. Alternatively, the organic gas may be mixed with a diluent gas.

The carrier gas 22 is an inert gas such as nitrogen, argon, or helium.

The organic substance gas 21 and carrier gas 22 are mixed at a predetermined ratio, and introduced into the vacuum vessel 12. The flow rates and mixing ratio of the gases 21 and 22 are controlled by the corresponding gas flow controllers 24. Each gas flow controller 24 is constituted by a mass-flow controller, solenoid valve, and the like. The gas mixture is heated to a proper temperature by a heater (not shown) arranged around the pipe 28, and then introduced into the vacuum vessel 12 via the inlet port 15. The heating temperature of the gas mixture is preferably equal to the temperature of the electron source substrate 10.

Note that the dehumidifying filters 23 are more preferably arranged midway along the pipe 28 to dehumidify the introduction gases. Each dehumidifying filter 23 can use a moisture absorption material such as silica gel, molecular sieves, or magnesium hydroxide.

The gas mixture introduced into the vacuum vessel 12 is exhausted by the vacuum pump 26 via the exhaust port 16 at a predetermined exhaust rate, and the pressure of the gas mixture in the vacuum vessel 12 is kept constant. The vacuum pump 26 used in the present invention is a low-vacuum pump such as a dry pump, diaphragm pump, or scroll pump, and is preferably an oil-free pump.

In this embodiment, the pressure of the gas mixture, which depends on the kind of organic substance used for activation, is preferably equal to or higher than a pressure at which a mean free path $\lambda$ of gas molecules constituting the gas mixture is much smaller than the internal size of the vacuum vessel 12, in order to shorten the time of the activation step and increase the uniformity. This pressure falls within a so-called viscous flow region, i.e., is a pressure of several hundred Pa (several Torr) to the atmospheric pressure.

Figure 19:
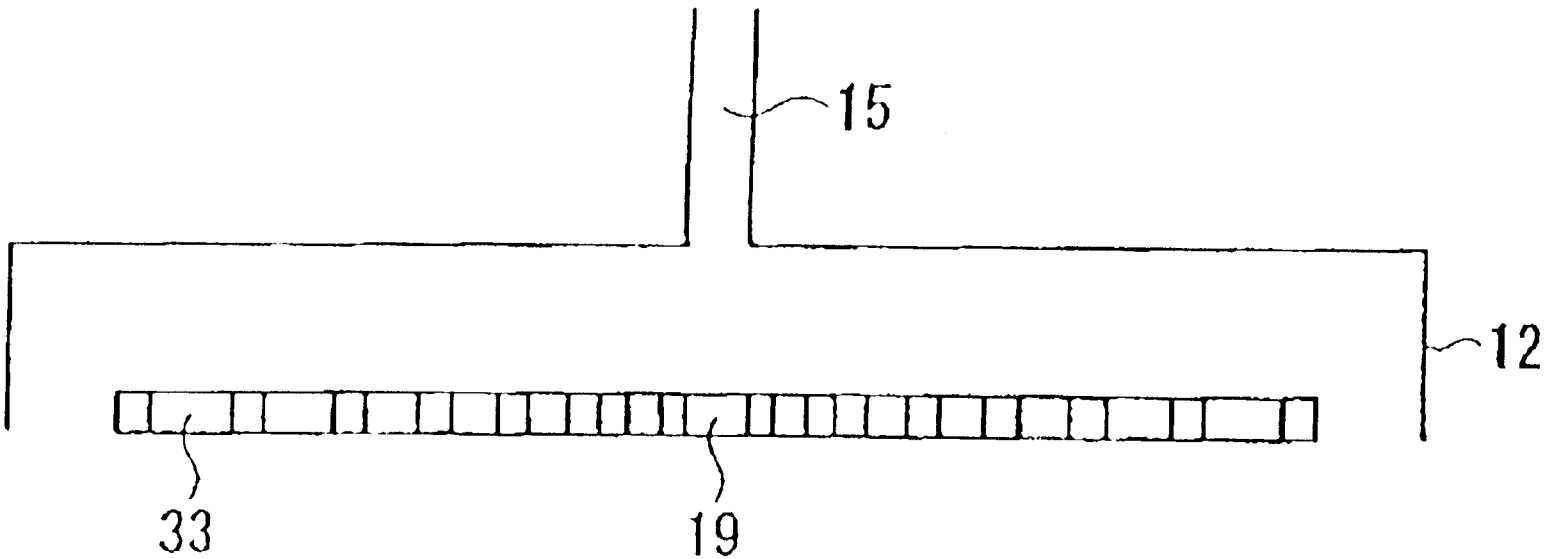
FIG. 19 is a sectional view showing the shape of a diffusion plate used in the electron source manufacturing apparatus according to the present invention.
Figure 20:
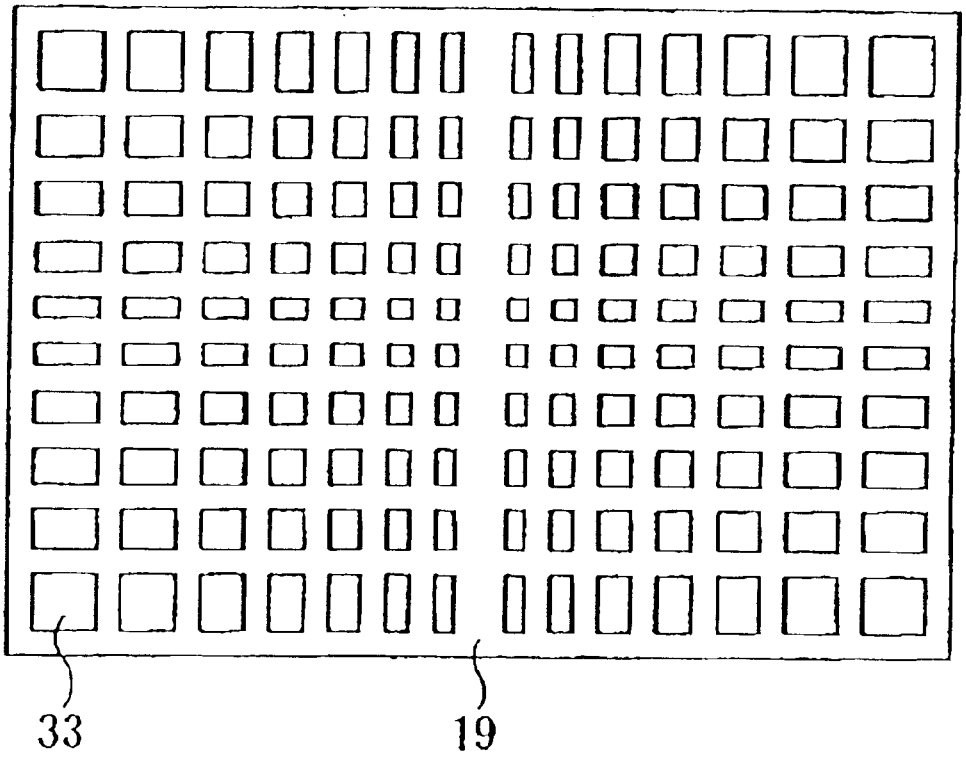
FIG. 20 is a plan view showing the shape of the diffusion plate used in the electron source manufacturing apparatus according to the present invention.

The diffusion plate 19 is preferably interposed between the gas inlet port 15 of the vacuum vessel 12 and the electron source substrate 10 because the diffusion plate 19 controls the flow of the gas mixture to uniformly supply the organic substance to the entire substrate, thereby increasing the uniformity of electron-emitting devices. As shown in FIGS. 1 and 3, the diffusion plate 19 is a metal plate having the openings 33. As shown in FIGS. 19 and 20, the openings 33 of the diffusion plate 19 are preferably formed such that the areas of the openings are changed, or the number of openings is changed between a region near the inlet port and a region apart from the inlet port.

In the diffusion plate 19, as openings are apart from the inlet port, the opening area is increased as shown in FIG. 20, or although not shown, the number of openings is increased, or the opening area is increased and the number of openings is increased. With this setting, the flow speed of the gas mixture flowing in the vacuum vessel 12 is made almost constant, increasing the uniformity. It is, however, important that the shape of the diffusion plate 19 must consider the features of a viscous flow. The shape of the diffusion plate 19 is not limited to the one described in this specification.

For example, the openings 33 are formed at an equal interval in a concentric shape and at an equiangular interval in the circumferential direction, and the opening area of the opening is set to satisfy the following equation. In this case, the opening area is set to increase in proportion to the distance from the substrate inlet port. With this setting, the introduction substance can be uniformly supplied on the surface of the electron source substrate, and electron-emitting devices can be uniformly activated.

$$S_d = S_0 \times [1 + (d/L)^2]^{1/2}$$

where d: distance from the intersection of a line extended from the center of the gas inlet port and the diffusion plate L: distance from the center of the gas inlet port to the intersection of the line extended from the center of the gas inlet port and the diffusion plate $S_d$: opening area at the distance d from the intersection of the line extended from the center of the gas inlet port and the diffusion plate $S_0$: opening area at the intersection of the line extended from the center of the gas inlet port and the diffusion plate The positions of the gas inlet port 15 and exhaust port 16 are not limited to this embodiment, and can take various positions. To uniformly supply an organic substance into the vacuum vessel 12, the positions of the gas inlet port 15 and exhaust port 16 are preferably vertically different positions in the vacuum vessel 12, as shown in FIGS. 1 and 3, or horizontally different positions, and more preferably almost symmetrical positions.

The extracted electrodes 30 of the electron source substrate are outside the vacuum vessel 12. The extracted electrodes 30 are connected to the wiring lines 31 using TAB wiring lines or probes, and connected to the driver 32.

In this embodiment, similar to the following embodiments, the vacuum vessel suffices to cover only the conductors 6 on the electron source substrate, so that the apparatus can be downsized. Since the wiring lines of the electron source substrate are outside the vacuum vessel, the electron source substrate can be easily electrically connected to a power source device (driver) for performing electrical processing.

While the gas mixture containing the organic substance is flowed in the vacuum vessel 12 in the above manner, a pulse voltage can be applied to each electron-emitting device on the substrate 10 via the wiring line 31, thereby activating the electron-emitting device.

Figure 4:
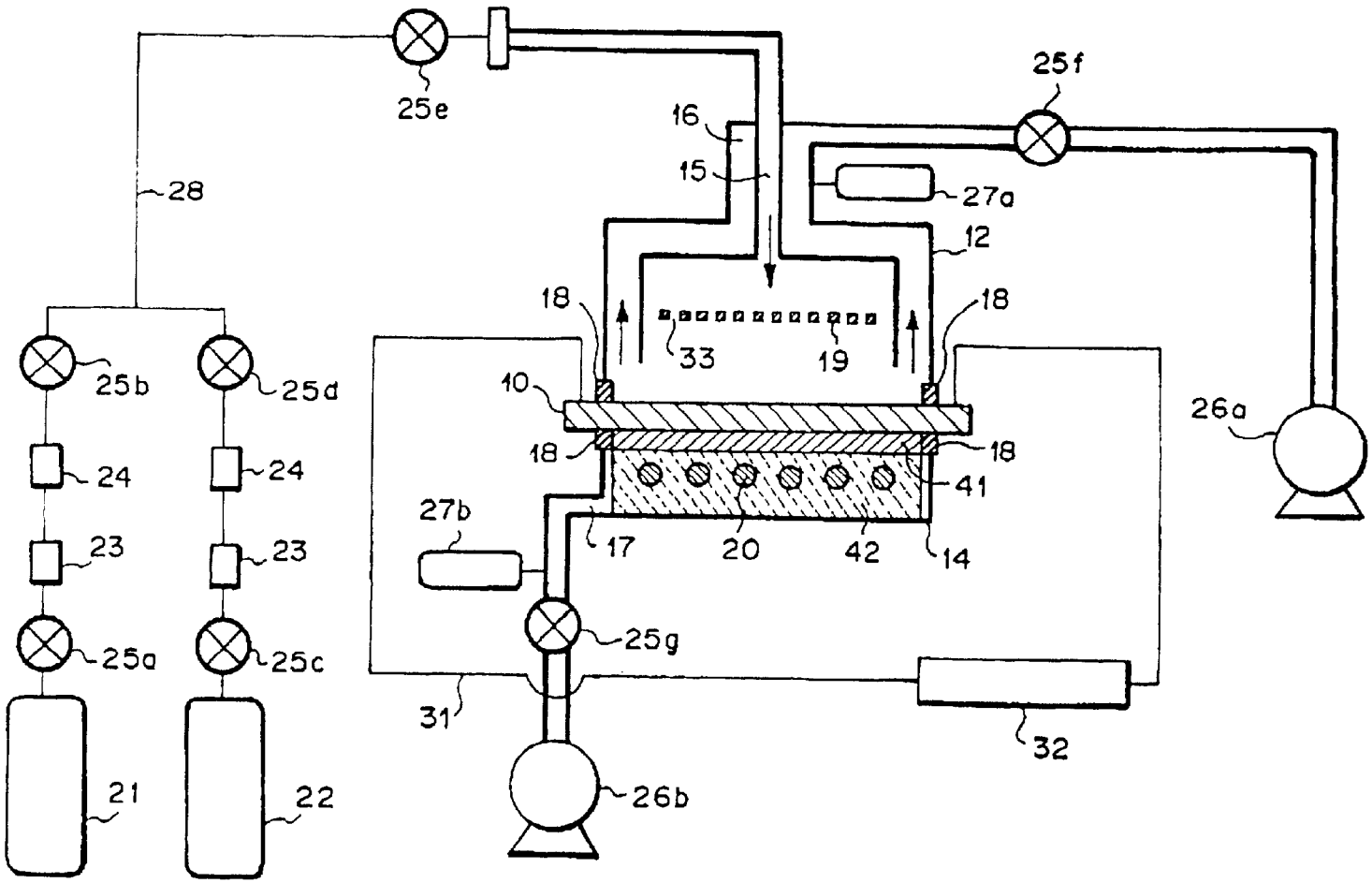
FIG. 4 is a sectional view showing the arrangement of an electron source manufacturing apparatus having an auxiliary vacuum vessel according to the present invention.
Figure 5:
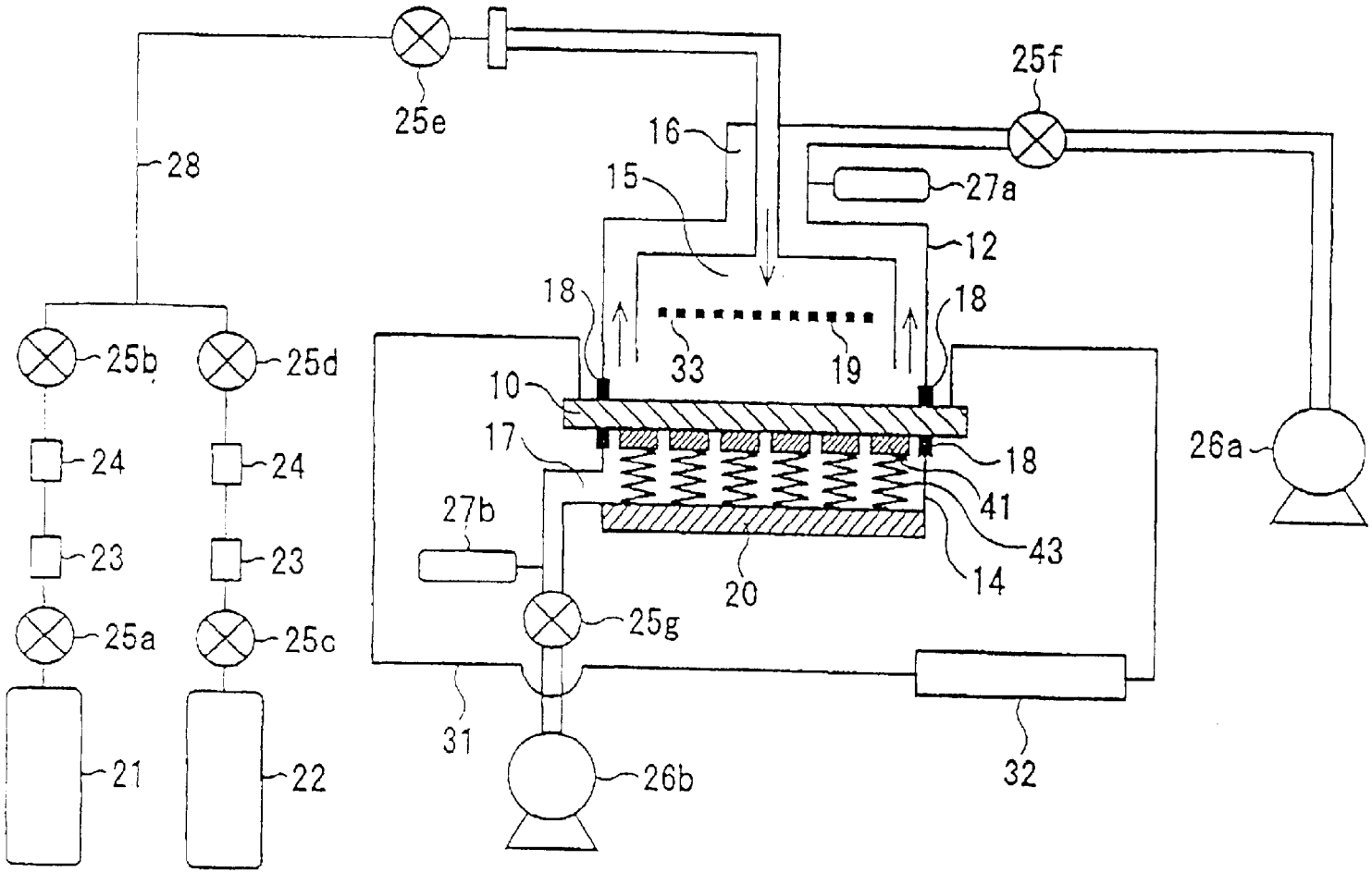
FIG. 5 is a sectional view showing another arrangement of the electron source manufacturing apparatus having the auxiliary vacuum vessel according to the present invention.

The second preferred embodiment of the present invention will be described below. This embodiment is mainly different in the support method of the electron source substrate 10 in the first embodiment, and the remaining arrangement is the same as in the first embodiment. FIGS. 4 and 5 are views showing the second preferred embodiment of the present invention. In FIGS. 4 and 5, reference numeral 12 denotes a vacuum vessel; 14, an auxiliary vacuum vessel; and 17, an exhaust port of the auxiliary vacuum vessel 14. The same reference numerals as in FIGS. 1 to 3 denote the same parts.

In the first embodiment, when the size of the electron source substrate 10 is large, the electron source substrate 10 is made thick enough to stand the pressure difference, or the vacuum chucking method of the electron source substrate 10 is adopted to relax the pressure difference in order to prevent damage to the electron source substrate 10 caused by the pressure difference between the upper surface and lower surface of the electron source substrate 10, i.e., the pressure difference between the internal pressure of the vacuum vessel 12 and the atmospheric pressure.

In the second embodiment, the pressure difference via an electron source substrate 10 is eliminated or minimized. In this embodiment, the electron source substrate 10 can be made thin. When the electron source substrate 10 is applied to an image forming apparatus, a lightweight image forming apparatus can be implemented. In this embodiment, the electron source substrate 10 is held between the vacuum vessel 12 and the auxiliary vacuum vessel 14. The internal pressure of the auxiliary vacuum vessel 14, which is a substitute of the support 11 in the first embodiment, is kept almost equal to the pressure of the vacuum vessel 12, thereby horizontally holding the electron source substrate 10.

The internal pressures of the vacuum vessel 12 and auxiliary vacuum vessel 14 are respectively set by vacuum gauges 27*a* and 27*b*. By adjusting the opening/closing degree of a valve 25*g* of the exhaust port of the auxiliary vacuum vessel 14, the internal pressures of the vacuum vessels 12 and 14 can be adjusted almost equal.

In FIG. 4, the auxiliary vacuum vessel 14 incorporates, as heat conduction members of the electron source substrate 10, a sheet-like first heat conduction member 41 made of the same material as a sealing member 18, and a second heat conduction member 42 which is made of a metal having a high thermal conductivity so as to dissipate heat from the electron source substrate 10 via the heat conduction member 41 at high efficiency and externally dissipate the heat via the auxiliary vacuum vessel 14. Note that FIGS. 4 and 5 show the auxiliary vacuum vessel 14 with a larger thickness than the actual one so as to facilitate understanding of the schematic arrangement of the apparatus.

A heater is buried in the second heat conduction member 42 so as to heat the electron source substrate 10, and the temperature can be externally controlled by a control mechanism (not shown).

The second heat conduction member 42 incorporates a tubular closed vessel capable of holding or circulating fluid. By externally controlling the temperature of the fluid, the electron source substrate 10 can be cooled or heated via the first heat conduction member 41. Alternatively, a heater can be set at the bottom of the auxiliary vacuum vessel 14 or buried in the bottom, and a control mechanism (not shown) for externally controlling the temperature can be arranged to heat the electron source substrate 10 via the second heat conduction member 42 and first heat conduction member 41. Alternatively, such heating means can be arranged in both the second heat conduction member 42 and auxiliary vacuum vessel 14 to control the temperature so as to heat or cool the electron source substrate 10.

This embodiment uses the two heat conduction members 41 and 42. However, the heat conduction member may be formed from one heat conduction member, or three or more heat conduction members, and is not limited to this embodiment.

Figure 6:
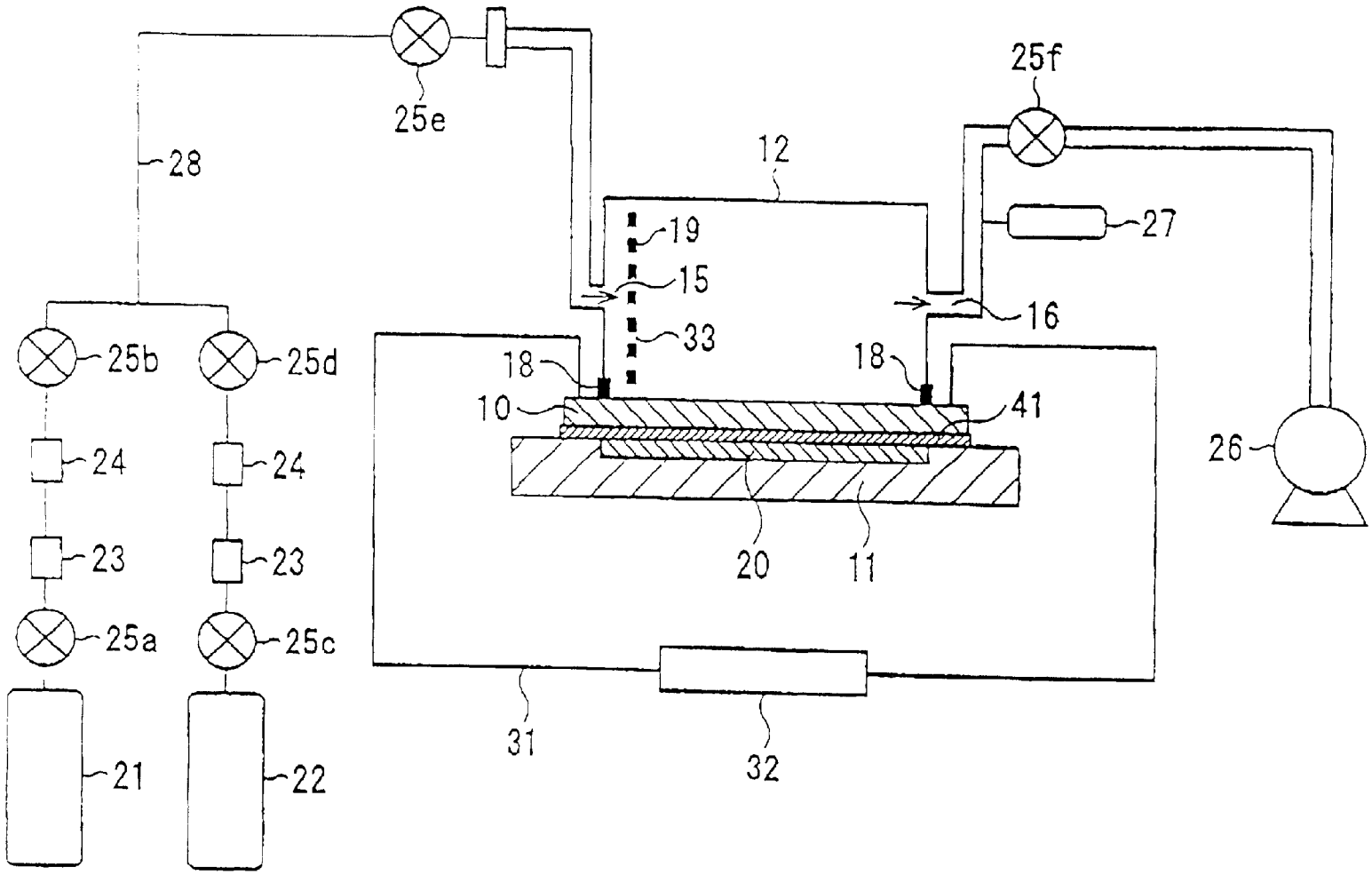
FIG. 6 is a sectional view showing still another arrangement of the electron source manufacturing apparatus having the auxiliary vacuum vessel according to the present invention.

The positions of a gas inlet port 15 and exhaust port 16 are not limited to this embodiment, and can take various positions. To uniformly supply an organic substance to the vacuum vessel 12, the positions of the gas inlet port 15 and exhaust port 16 are preferably vertically different positions in the vacuum vessel 12, as shown in FIGS. 4 and 5, or horizontally different positions in a vacuum vessel as shown in FIG. 6 in the first embodiment, and more preferably almost symmetrical positions.

When this embodiment also has the step of introducing gas into the vacuum vessel 12, similar to the first embodiment, a diffusion plate 19 described in the first embodiment is preferably used in the same fashion as in the first embodiment. While a gas mixture containing an organic substance is flowed, a pulse voltage can be applied to each electron-emitting device on the substrate 10 via a wiring line 31 using a driver 32, thereby activating the electron-emitting device in the same way as in the first embodiment.

Also in this embodiment, similar to the first embodiment, the forming processing step or activation of the electron-emitting device can be performed. For activating the electron-emitting device, while the gas mixture containing the organic substance is flowed in the vacuum vessel 12, a pulse voltage is applied to each electron-emitting device on the substrate 10 via the wiring line 31 using the driver 32.

The third embodiment of the present invention will be described with reference to FIG. 14. In this embodiment, a substrate holder 207 comprises an electrostatic chuck 208 in order to prevent deformation of or damage to a substrate caused by the pressure difference between the upper surface and lower surface of the substrate. The electrostatic chuck fixes the substrate by applying a voltage between an electrode 209 inserted in the electrostatic chuck and a substrate 10, and chucking the substrate 10 to the substrate holder 207 by an electrostatic force. To keep a predetermined potential to a predetermined value on the substrate 10, a conductive film such as an ITO film is formed on the lower surface of the substrate. To chuck the substrate by the electrostatic chuck method, the distance between the electrode 209 and the substrate must be short. Thus, the substrate 10 is preferably temporarily pressed against the electrostatic chuck 208 by another method. In the apparatus shown in FIG. 14, the interiors of grooves 211 formed in the surface of the electrostatic chuck 208 are evacuated to chuck the substrate 10 to the electrostatic chuck by the atmospheric pressure. Then, a high voltage is applied from a high-voltage power source 210 to the electrode 209 to satisfactorily chuck the substrate. After that, even if the interior of a vacuum chamber 202 is evacuated, the pressure difference applied to the substrate can be canceled by the electrostatic force of the electrostatic chuck to prevent deformation of or damage to the substrate. To enhance heat conduction between the electrostatic chuck 208 and the substrate 10, heat exchange gas is desirably introduced into the grooves 211 temporarily evacuated in the above-described manner. The gas is preferably He, but another gas can also be effective. Introducing the heat exchange gas not only realizes heat conduction between the substrate 10 and the electrostatic chuck 208 at the grooves 211, but also increases heat conduction, compared to a case wherein the substrate 10 and electrostatic chuck 208 thermally contact each other even at a non-grooved portion. This greatly improves heat conduction on the entire substrate. In processing such as forming or activation, heat generated on the substrate 10 easily moves to the substrate holder 207 via the electrostatic chuck 208 to suppress generation of a temperature distribution caused by the temperature rise of the substrate 10 or local heat generation. If the substrate holder comprises temperature control means such as a heater 212 and cooling unit 213, the temperature of the substrate can be controlled at higher precision.

An example of an electron source manufacturing method using the above-described manufacturing apparatus will be described in detail below.

Figure 21:
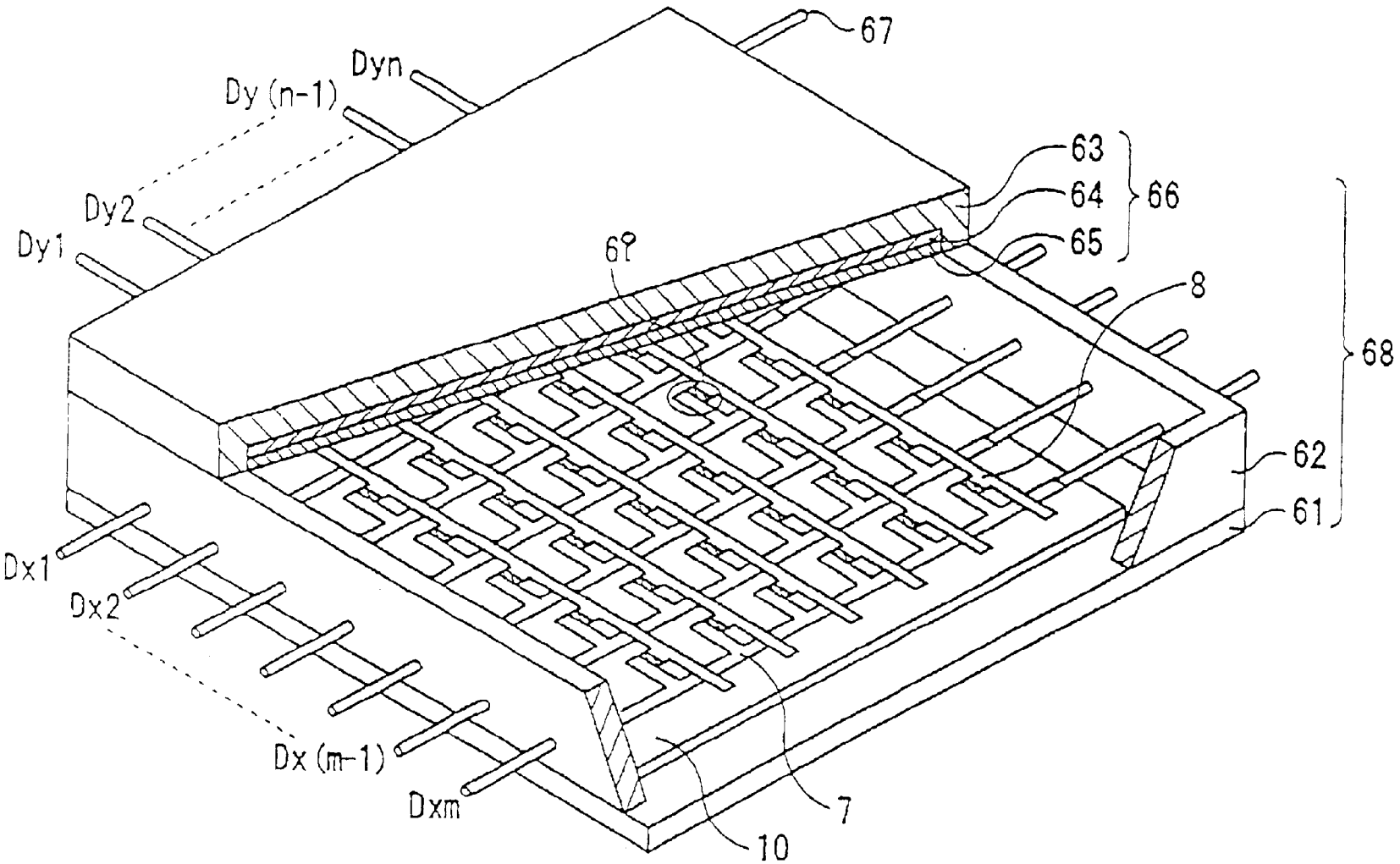
FIG. 21 is a partially cutaway perspective view showing the arrangement of an image forming apparatus.

By combining the electron source and an image forming member, an image forming apparatus as shown in FIG. 21 can be formed. FIG. 21 is a schematic view showing the image forming apparatus. In FIG. 21, reference numeral 69 denotes an electron-emitting device; 61, a rear plate to which the electron source substrate 10 is fixed; 62, a support; 66, a face plate made up of a glass substrate 63, metal back 64, and fluorescent substance 65; 67, a high-voltage terminal; and 68, an image forming apparatus.

In the image forming apparatus, electrons are emitted by applying scan signals and modulation signals from signal generation means (not shown) to respective electron-emitting devices via outer container terminals Dx1 to Dxm and Dy1 to Dyn. A high voltage of 5 kV is applied to the metal back 64 or a transparent electrode (not shown) via the high-voltage terminal 67 to accelerate the electron beam and collide it against the fluorescent film 65. The fluorescent film is excited, and emits light to display an image.

In some cases, the electron source substrate 10 itself serves as a rear plate, and the rear plate is constituted by one substrate. Scan signal wiring lines may be one-side scan wiring lines as shown in FIG. 21 for the number of devices free from any influence of an application voltage drop between an electron-emitting device near, e.g., the outer container terminal Dx1 and a distant electron-emitting device. If the number of devices is large, and the devices are influenced by a voltage drop, the wiring width is increased, the wiring thickness is increased, or voltages are applied from two sides.

EXAMPLES

The present invention will be explained in detail by way of examples. However, the present invention is not limited to the following examples, and includes modifications in which respective elements are replaced or the design is changed within the spirit and scope of the present invention.

Example 1

Figure 22:
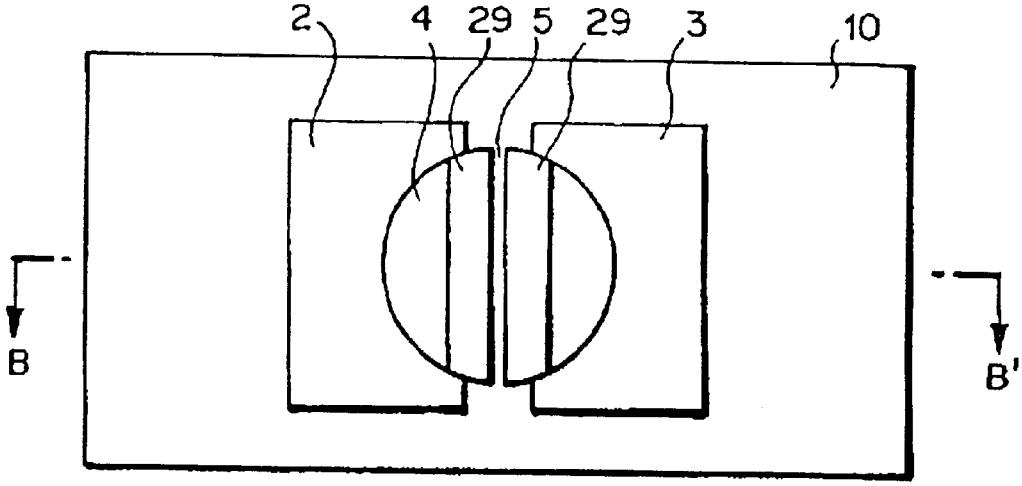
FIG. 22 is a plan view showing the arrangement of an electron-emitting device according to the present invention.
Figure 23:
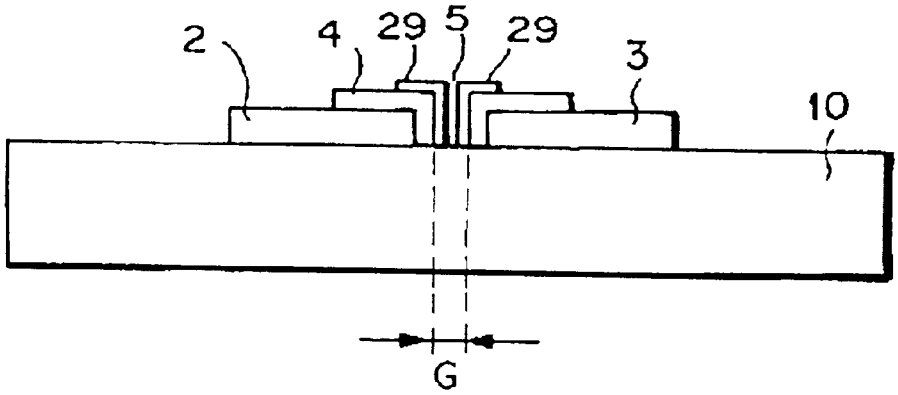
FIG. 23 is a sectional view showing the arrangement of the electron-emitting device according to the present invention taken along the line B-B' in FIG. 22.
Figure 24:
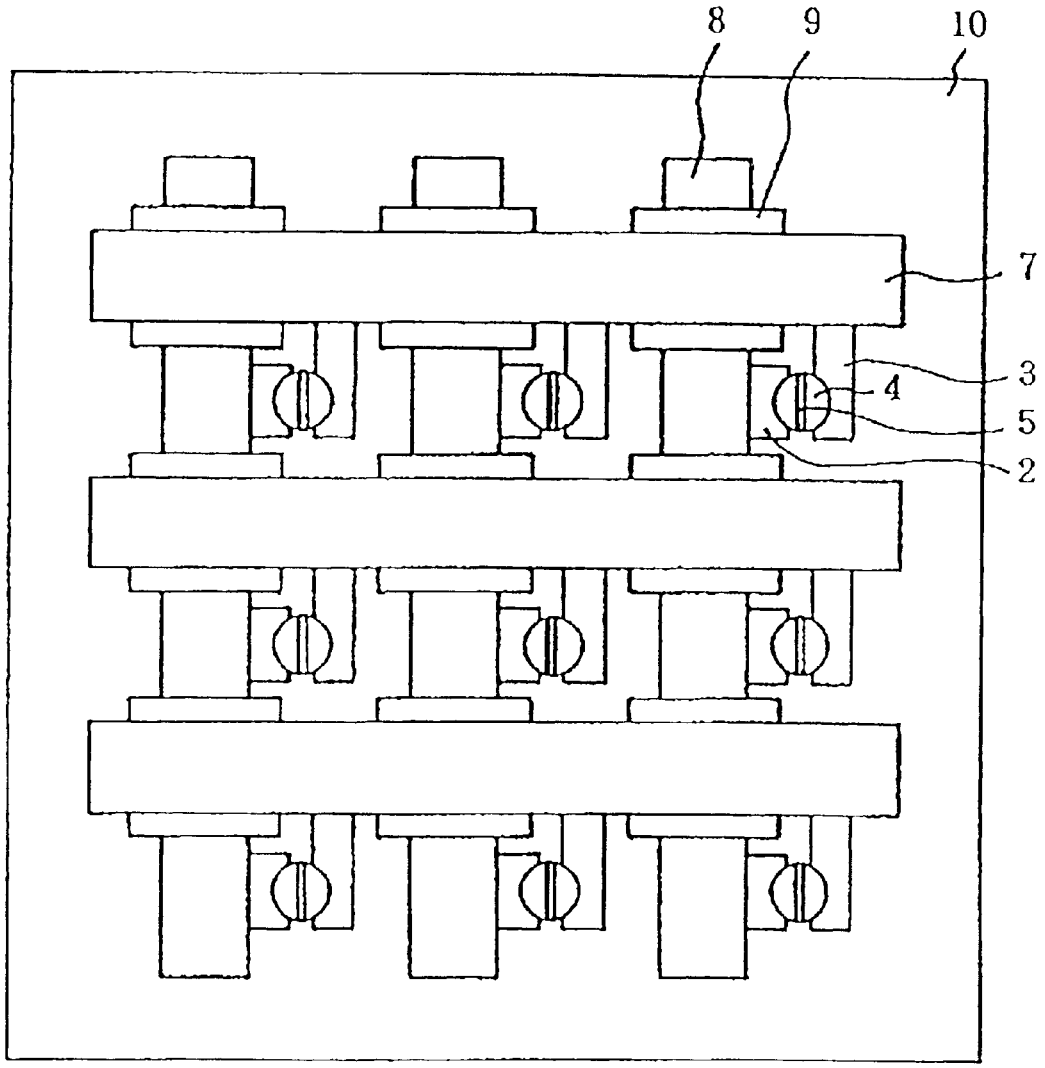
FIG. 24 is a plan view showing an electron source according to the present invention.

This example manufactures an electron source shown in FIG. 24 having a plurality of surface-conduction type electron-emitting devices shown in FIGS. 22 and 23 by using the manufacturing apparatus according to the present invention. In FIGS. 22 to 24, reference numeral 101 denotes a substrate; 2 and 3, device electrodes; 4, a conductive film; 29, a carbon film; and 5, a gap in the carbon films 29. Reference symbol G denotes a gap G in the conductive film 4. Pt paste was printed by an offset printing method on a glass substrate (350×300 mm in size and 5 mm in thickness) having an $SiO_2$ layer, and heated and baked to form device electrodes 2 and 3 shown in FIG. 25 with a thickness of 50 nm. Ag paste was printed by a screen printing method, and heated and baked to form X-direction wiring lines 7 (240 lines) and Y-direction wiring lines 8 (720 lines) shown in FIG. 25. At the intersections of the X-direction wiring lines 7 and Y-direction wiring lines 8, insulating pastes were printed by a screen printing method, and heated and baked to form insulating layers 9.

Figure 25:
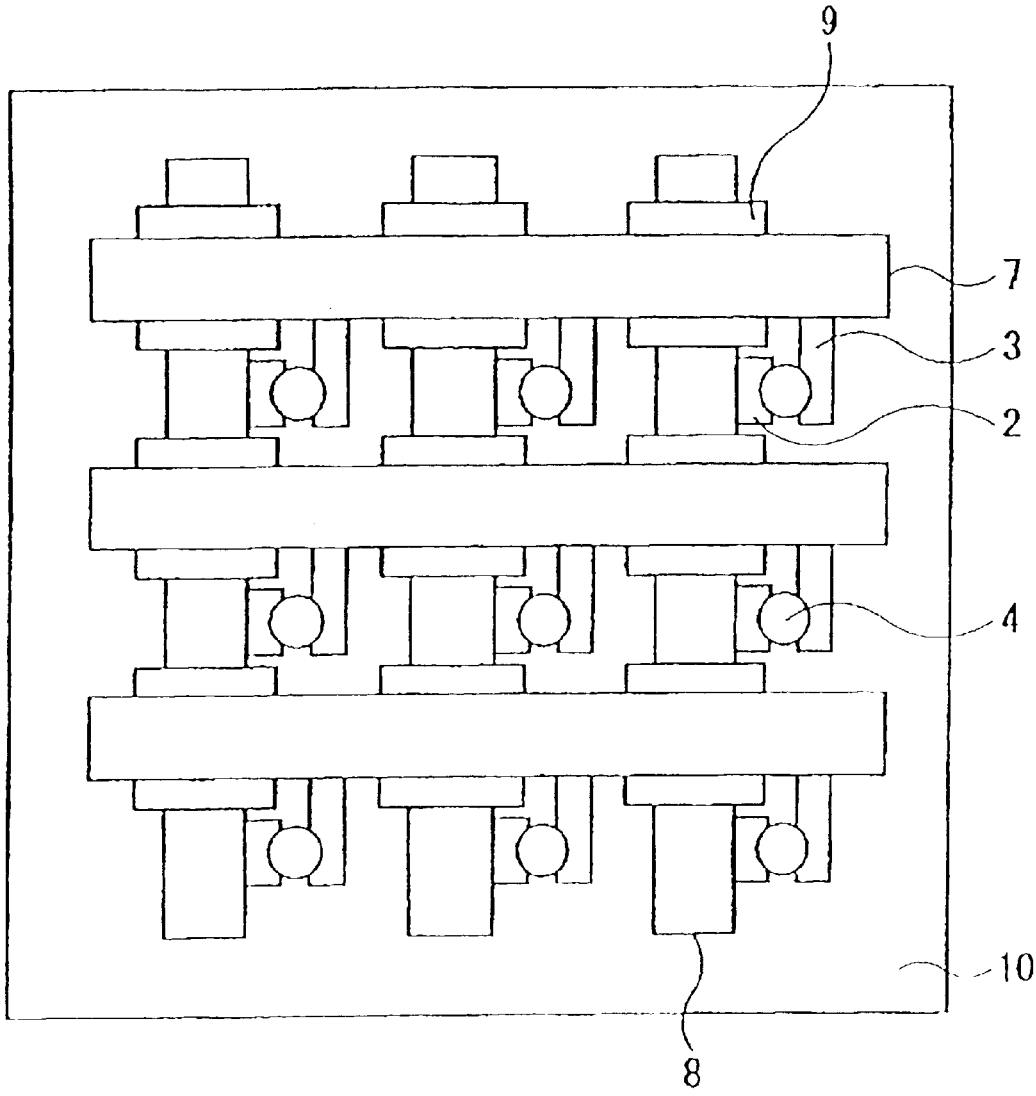
FIG. 25 is a plan view for explaining an electron source fabrication method according to the present invention.

A palladium complex solution was dropped between each pair of device electrodes 2 and 3 using a bubble-jet type injection device, annealed at 350° C. for 30 min to form a conductive film 4 made of fine particles of palladium oxide shown in FIG. 25. The conductive film 4 had a film thickness of 20 nm. In this way, an electron source substrate 10 on which a plurality of conductors each made up of a pair of device electrodes 2 and 3 and the conductive film 4 were wired in a matrix by the X-direction wiring lines 7 and Y-direction wiring lines 8 was fabricated.

Warpage and undulation of the substrate were observed to find that the periphery warped by 0.5 mm with respect to the center of the substrate owing to the original warpage and undulation of the substrate, and warpage and undulation of the substrate supported to be generated by the heating step.

The fabricated electron source substrate 10 was fixed on a support 11 of the manufacturing apparatus shown in FIGS. 1 and 2. A heat conduction rubber sheet 41 having a thickness of 1.5 mm was sandwiched between the support 11 and the electron source substrate 10.

A stainless steel vacuum vessel 12 was set on the electron source substrate 10 as shown in FIG. 2 so as to set extracted wiring lines 30 outside the vacuum vessel 12 via a silicone rubber sealing member 18. A metal plate having openings 33 as shown in FIGS. 19 and 20 was set as a diffusion plate 19 above the electron source substrate 10.

A valve 25*f* on an exhaust port 16 side was opened to evacuate the interior of the vacuum vessel 12 by a vacuum pump 26 (scroll pump in this case) to about $1.33\times10^{-1}$ Pa ($1\times10^{-3}$ Torr). Thereafter, to remove moisture assumed to attach to the pipe of the exhaust device or the electron source substrate, the temperature was increased up to 120° C. using a pipe heater (not shown) and a heater 20 for the electron source substrate 10. The temperature was held for 2 hours, and then gradually decreased to room temperature.

After the temperature of the substrate returned to room temperature, a voltage was applied between the device electrodes 2 and 3 of each electron-emitting device 6 via the X-direction wiring line 7 and Y-direction wiring line 8 using a driver 32 connected to the extracted wiring line 30 via a wiring line 31 shown in FIG. 2. In this manner, forming processing was done for the conductive film to form a gap G shown in FIG. 23 in the conductive film 4.

Subsequently, activation processing was done using the same apparatus. Gas supply valves 25*a* to 25*d* shown in FIG. 1 and a valve 25*e* on a gas inlet port 15 side were opened to introduce a gas mixture of an organic substance gas 21 and carrier gas 22 into the vacuum vessel 12. The organic substance gas 21 was 1% ethylene-mixed nitrogen gas, and the carrier gas 22 was nitrogen gas. Their flow rates were 40 sccm and 400 sccm, respectively. While the pressure of a vacuum gauge 27 on the exhaust port 16 side was checked, the opening/closing degree of the valve 25*f* was adjusted to set the internal pressure of the vacuum vessel 12 to $133\times10^{2}$ Pa (100 Torr).

About 30 min after introduction of the organic substance gas started, activation processing was done by applying a voltage between the device electrodes 2 and 3 of each electron-emitting device 6 via the X-direction wiring line 7 and Y-direction wiring line 8 using the driver 32. The voltage was controlled to rise from 10 V to 17 V within about 25 min. The pulse width was 1 msec, the frequency was 100 Hz, and the activation time was 30 min. Activation was performed by a method of commonly connecting all the Y-direction wiring lines 8 and unselected lines of the X-direction wiring lines 7 to Gnd (ground potential), selecting 10 lines of the X-direction wiring lines 7, and sequentially applying a 1-msec pulse voltage in units of lines. This method was repeated to perform activation for all the X-direction lines. This method required 12 hours for activation of all the lines.

The device current If (current flowing between the device electrodes of the electron-emitting device) at the end of activation processing was measured for each X-direction wiring line, and device current If values were compared to find that the value was from about 1.35 A to 1.56 A, and was 1.45 A on average (corresponding to about 2 mA per device), and variations for each wiring line were about 8%. Sufficient activation processing could be performed.

Carbon films 29 were formed via a gap 5 on the electron-emitting device having undergone activation processing, as shown in FIGS. 22 and 23.

In activation processing, a mass spectrometer (not shown) with a differential exhaust device was used to analyze gas on the exhaust port 16 side to find that mass No. 28 of nitrogen and ethylene and mass No. 26 of an ethylene fragment instantaneously increased to be saturated, and the two values were constant during activation processing.

The time required for the manufacturing process can be shortened, and the uniformity of the characteristics of electron-emitting devices of the electron source can be increased, compared to a case wherein the forming processing step and activation processing were performed to fabricate an image forming apparatus as shown in FIG. 21 in which an electron source substrate 10 shown in FIG. 25 that was identical to the substrate 10 in Example 1 was fixed to a rear plate 61 as shown in FIG. 21 which is a schematic view of the image forming apparatus, then a face plate 66 was arranged 5 mm above the electron source substrate 10 via a support frame 62, a getter material, and an exhaust pipe (not shown) 10 mm in inner diameter and 14 mm in outer diameter, and the resultant structure was sealed using frit glass in an argon atmosphere at 420° C.

Warpage of a substrate large in substrate size readily causes a decrease in yield and variations in characteristics. By setting the heat conduction member in Example 1, an increase in yield and reduction of variations in characteristics could be realized.

Example 2

An electron source substrate 10 shown in FIG. 25 that was identical to the substrate 10 in Example 1 was fabricated and set in the manufacturing apparatus of FIG. 1. In this example, a gas mixture containing an organic substance was heated to 80° C. by a heater arranged around a pipe 28, and then introduced into a vacuum vessel 12. The electron source substrate 10 was heated via a heat conduction member 41 using a heater 20 inside a support 11 to set the substrate temperature to 80° C. Except for this, activation processing was executed similarly to Example 1, thereby fabricating an electron source.

Carbon films 29 were formed via a gap 5 on an electron-emitting device having undergone activation processing, as shown in FIGS. 23 and 24.

Similar to Example 1, this example could perform activation processing within a short time. The device current If at the end of activation processing was measured similarly to Example 1 to find that the device current If increased about 1.2 times, compared to Example 1. Variations of the device current If were about 5%, and activation processing excellent in uniformity could be done.

The present inventors estimate that heating relaxed a temperature distribution caused by heat generated in the activation processing step, and further heating promoted chemical reaction in the activation processing step.

Example 3

An electron source was fabricated by the same method as in Example 1 except that the manufacturing apparatus shown in FIG. 3 was used for an electron source substrate 10 shown in FIG. 25 that was identical to the substrate 10 in Example 1, and silicone oil was used as a heat conduction member.

In the apparatus of this example, holes (not shown) serving as both air holes and viscous liquid substance discharge holes were formed at positions on an almost diagonal line outside the device electrode region so as not to leave air between the lower surface of the substrate and a support in injecting silicone oil below the substrate using a viscous liquid substance inlet pipe. The device current value at the end of activation processing was the same as the result of Example 1.

Example 4

This example concerns another electron source manufacturing example. An electron source substrate 10 shown in FIG. 25 that was fabricated using a glass substrate having an $SiO_2$ layer 3 mm in thickness, similar to Example 1 was set between a vacuum vessel 12 and auxiliary vacuum vessel 14 of the manufacturing apparatus shown in FIG. 4 via a silicone rubber sealing member 18, sheet-like silicone rubber heat conduction member 41 having cylindrical projections on a surface in contact with the electron source substrate 10, and an aluminum heat conduction member 42 incorporating a buried heater.

Unlike the case shown in FIG. 4, this example executed activation processing without setting any diffusion plate 19.

A valve **25*f* of the vacuum vessel 12 on an exhaust port 16 side and a valve 25*g* of the auxiliary vacuum vessel 14 on an exhaust port 17 side were opened to evacuate the interiors of the vacuum vessel 12 and auxiliary vacuum vessel 14 to $1.33\times10^{-1}$ Pa ($1\times10^{-3}$ Torr) by vacuum pumps 26*a* and 26*b*** (scroll pumps in this case).

Evacuation was done while (the internal pressure of the vacuum vessel 12)≧ (the internal pressure of the auxiliary vacuum vessel 14) was maintained. When the substrate deforms and distorts owing to the pressure difference, the substrate warps toward the auxiliary vacuum vessel, and is pressed against the projecting heat conduction member. The heat conduction member suppresses the deformation, and supports the electron source substrate 10.

When the electron source substrate 10 is large in size and small in thickness, or vice versa, i.e., (the internal pressure of the vacuum vessel 12)≦ (the internal pressure of the auxiliary vacuum vessel 14) is held, and the electron source substrate 10 warps toward the vacuum vessel 12, the substrate is damaged toward the vacuum vessel 12 in the worst case because the vacuum vessel 12 does not comprise any member for suppressing deformation of the electron source substrate 10 caused by the pressure difference and supporting the substrate 10. In other words, as the substrate is larger in size and smaller in thickness, the heat conduction member also serving as a substrate support member becomes more important in the electron source manufacturing apparatus of this example.

Similar to Example 1, a voltage was applied between electrodes 2 and 3 of each electron-emitting device 6 via an X-direction wiring line 7 and Y-direction wiring line 8 using a driver 32 to perform forming processing for a conductive film 4, thereby forming a gap G shown in FIG. 23 in the conductive film 4. In Example 3, in order to promote formation of a fissure in the conductive film at the same time as the start of voltage application, hydrogen gas which reduces palladium oxide was gradually introduced from a pipe of another system (not shown) to $533\times10^2$ pa (about 400 Torr).

Activation processing was done using the same apparatus. Gas supply valves **25*a* to 25*d* and a valve 25*e* on the gas inlet port 15 side were opened to introduce a gas mixture of an organic substance gas 21 and carrier gas 22 into the vacuum vessel 12. The organic gas 21 was 1% propylene-mixed nitrogen gas, and the carrier gas 22 was nitrogen gas. Their flow rates were 10 sccm and 400 sccm, respectively. After these gases were passed through corresponding dehumidifying filters 23, the gas mixture was introduced into the vacuum vessel 12. While the pressure of a vacuum gauge 27*a* on the exhaust port 16 side was checked, the opening/closing degree of the valve 25*f* was adjusted to set the internal pressure of the vacuum vessel 12 to $266\times10^2$ Pa (200 Torr). At the same time, the opening/closing degree of the valve 25*g* of the auxiliary vacuum vessel 14 on the exhaust port 17 side was adjusted to set the internal pressure of the auxiliary vacuum vessel 14** to $266\times10^2$ Pa (200 Torr).

Similar to Example 1, a voltage was applied between the electrodes 2 and 3 of each electron-emitting device 6 via the X-direction wiring line 7 and Y-direction wiring line 8 using the driver 32 to perform activation processing. The device current If in activation processing was measured by the same method as in Example 1 to find that the device current If was from 1.34 A to 1.53 A, and variations were about 7%. Sufficient activation processing could be performed.

Note that carbon films 29 were formed via a gap 5 on the electron-emitting device having undergone activation processing, as shown in FIGS. 22 and 23.

In activation processing, a mass spectrometer (not shown) with a differential exhaust device was used to analyze gas on the exhaust port 16 side to find that mass No. 28 of nitrogen and mass No. 42 of propylene instantaneously increased to be saturated, and the two values were constant during activation processing.

In this example, the gas mixture containing the organic substance was introduced into the vacuum vessel 12 set on the electron source substrate 10 having electron-emitting devices at a pressure of $266\times10^2$ Pa (200 Torr) falling within the viscous flow region, so that the organic substance could be made uniform within a short period. Resultantly, the time required for activation processing could be greatly shortened.

Example 5

In this example, a diffusion plate 19 as shown in FIGS. 19 and 20 was set in a vacuum vessel 12. Except for this, the same apparatus shown in FIG. 4 was used, similar to Example 4. Formation of a gap G in a conductive film shown in FIG. 23 by forming processing, and activation processing were practiced to fabricate an electron source, similar to Example 4.

Similar to Example 4, this example could perform activation processing within a short time. Note that carbon films 29 were formed via a gap 5 on an electron-emitting device having undergone activation processing, as shown in FIGS. 22 and 23. The device current If at the end of activation processing was measured by the same method as in Example 4 to find that the value of the device current If was from 1.36 A to 1.50 A, and variations were about 5%. Activation processing excellent in uniformity could be done.

Example 6

In this example, the apparatus shown in FIG. 4 that was used in Example 5 adopted a heater 20 buried in a heat conduction member 42. This heater was controlled by an external control device to heat an electron source substrate 10 via heat conduction members 42 and 41 so as to set the substrate temperature to 80° C. Further, gas was heated by a heater arranged around a pipe 28 to perform activation processing. Except for this, activation processing was done similarly to Example 5.

Carbon films 29 were formed via a gap 5 on an electron-emitting device having undergone activation processing, as shown in FIGS. 22 and 23.

The device current If at the end of activation processing was measured similarly to Example 4 to find that the device current If was from 1.37 A to 1.48 A, and variations were about 4%. Sufficient activation processing could be done.

Example 7

This example used, as heat conduction members 41, a silicone rubber sheet which was divided and processed into a three-dimensional shape with several grooves for giving a non-slip effect to a surface in contact with a substrate. The apparatus shown in FIG. 5 using heat conduction spring-shaped members 43 made of stainless steel was adopted. A heater 20 buried in the lower portion of an auxiliary vacuum vessel was controlled by an external control device (not shown), and an electron source substrate 10 was heated via the heat conduction spring members 43 and heat conduction members 41. Except for this, an electron source was fabricated by the same method as in Example 6. As a result, a high-quality electron source could be fabricated, similar to Example 6.

Example 8

In this example, an electron source was fabricated by the same method as in Example 7 except that processing which was executed every 10 lines was simultaneously performed for 2 lines in activation processing, and executed every 20 lines. The device current If at the end of activation processing was measured by the same method as in Example 7 to find that the value of the device current If was from 1.36 A to 1.50 A, and variations slightly increased to about 5%.

The present inventors estimate that increasing the number of processing lines generated a larger amount of heat, and the heat distribution influenced fabrication of the electron source.

In the electron source manufacturing apparatuses according to Examples 5 to 8, heat conduction members were employed to effectively increase the fabrication yield and characteristics of an electron source substrate.

Example 9

This example relates to an image forming apparatus as shown in FIG. 21 as an application of an electron source fabricated by the present invention. Similar to Example 2, an electron source substrate 10 having undergone forming and activation processes was fixed to a rear plate 61. A face plate 66 was arranged 5 mm above the electron source substrate 10 via a support frame 62 and an exhaust pipe (not shown). The resultant structure was sealed using frit glass in an argon atmosphere at 420° C.

As will be described later, a member (not shown) for maintaining the space between the electron source substrate 10 and the face plate 66 was arranged on the electron source substrate 10 so as not to damage a container by the atmospheric pressure even if the interior of the container fabricated by sealing was evacuated to the atmospheric pressure or less.

Figure 10A:
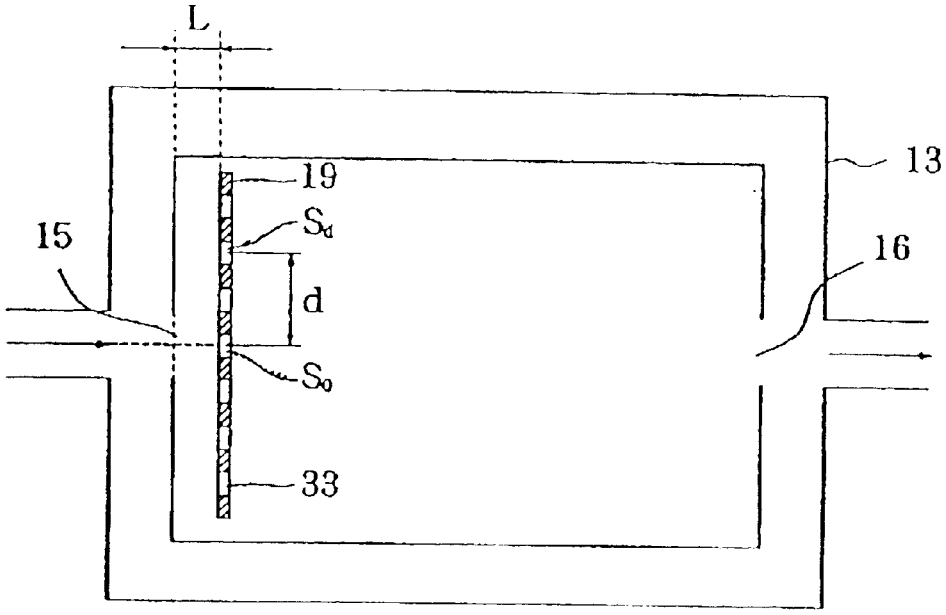
FIGS. 10A and 10B are schematic views each showing the shapes of a first vessel and diffusion plate in FIG. 9.
Figure 10B:
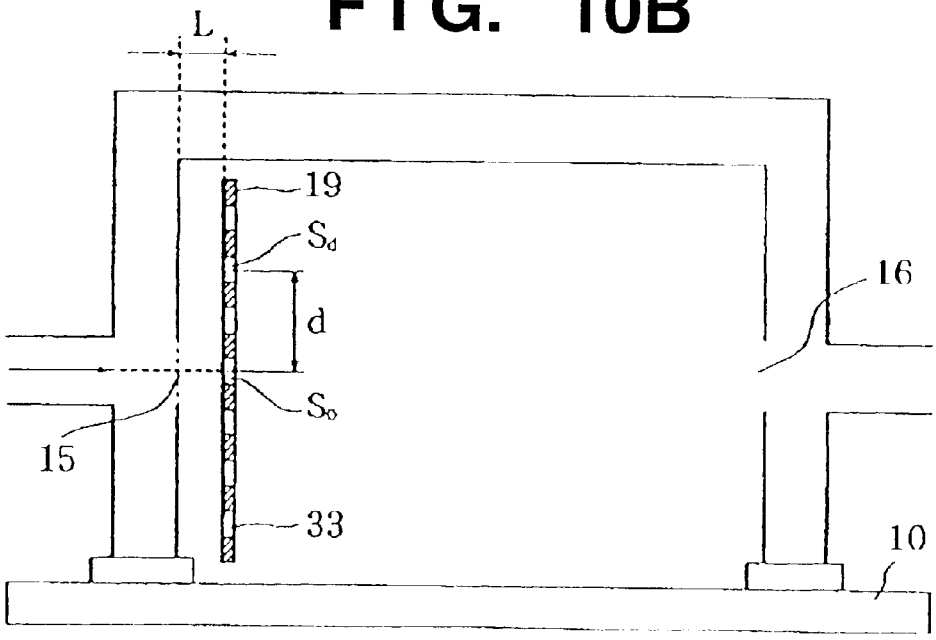

After the interior of the container was evacuated, and the internal pressure of the container was set to the atmospheric pressure or less, the exhaust pipe was sealed to fabricate an image forming apparatus as shown in FIGS. 10A and 10B. To maintain the internal pressure of the sealed container, processing by a high-frequency heating method for a getter material (not shown) set in the container was practiced.

In the image forming apparatus completed in this manner, electrons were emitted by applying scan signals and modulation signals from signal generation means (not shown) to respective electron-emitting devices via outer container terminals Dx1 to Dxm and Dy1 to Dyn. A high voltage of 5 kV was applied to a metal back 65 or a transparent electrode (not shown) via a high-voltage terminal 67 to accelerate the electron beam and collide it against a fluorescent film 64. The fluorescent film 64 was excited and emitted light to display an image. The image forming apparatus according to this example could display an image with sufficient quality as a television without any luminance variation and color nonuniformity by visual check.

The electron source manufacturing apparatus and manufacturing method according to this example are also effectively applied to the manufacture of an image forming apparatus, and can contribute to an increase in the image quality of a display image. According to the manufacturing apparatuses and manufacturing methods of Examples 1 to 9, the organic substance introduction time in the activation step can be shortened to shorten the manufacturing time and increase the yield. The use of the manufacturing apparatuses and manufacturing methods can provide an electron source excellent in uniformity.

A high-vacuum exhaust device can be eliminated to reduce the apparatus manufacturing cost. Since such manufacturing apparatus suffices to have a small-size vacuum vessel which covers only electron-emitting devices on an electron source substrate, the apparatus can be downsized.

Since the extracted wiring lines of the electron source substrate are outside the vacuum vessel, the electron source substrate and driver can be easily electrically connected.

Using an electron source fabricated by the manufacturing apparatus of the present invention can provide an image forming apparatus excellent in uniformity.

Example 10

This example manufactured an electron source shown in FIGS. 22 and 23 by using the manufacturing apparatus according to the present invention.

Pt paste was printed by an offset printing method on a glass substrate having an $SiO_2$ layer, and heated and baked to form device electrodes 2 and 3 shown in FIG. 25 with a thickness of 50 nm. Ag paste was printed by a screen printing method, and heated and baked to form X-direction wiring lines 7 and Y-direction wiring lines 8 shown in FIG. 25. At the intersections of the X-direction wiring lines 7 and Y-direction wiring lines 8, insulating pastes were printed by a screen printing method, and heated and baked to form insulating layers 9.

A palladium complex solution was dropped between each pair of device electrodes 2 and 3 using a bubble-jet type injection device, annealed at 350° C. for 30 min to form a conductive film 4 made of palladium oxide shown in FIG. 25. The conductive film 4 had a film thickness of 20 nm. In this way, an electron source substrate 10 on which a plurality of conductors each made up of a pair of device electrodes 2 and 3 and the conductive film 4 were wired in a matrix by the X-direction wiring lines 7 and Y-direction wiring lines 8 was fabricated.

Figure 7:
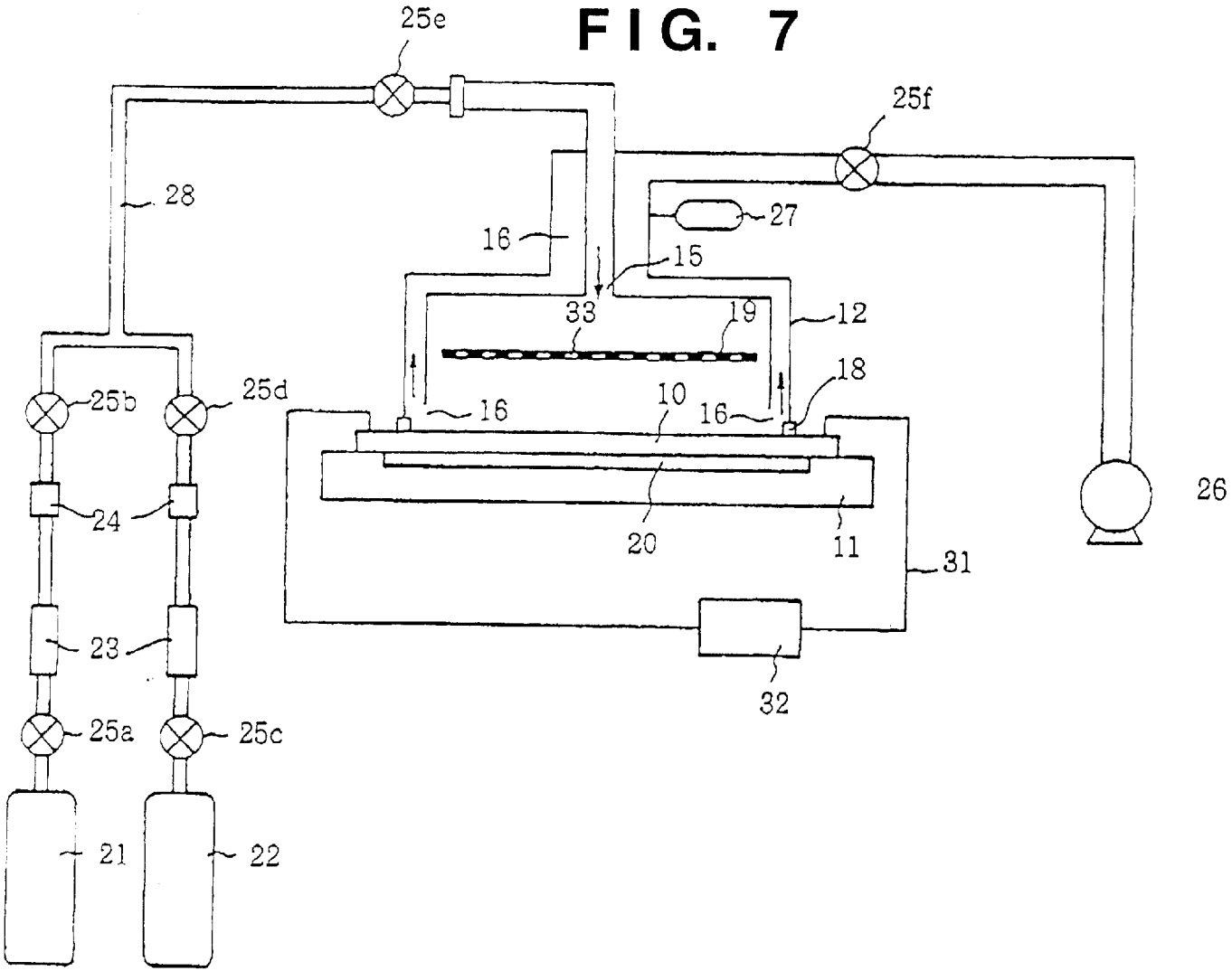
FIG. 7 is a sectional view showing still another arrangement of the electron source manufacturing apparatus according to the present invention.
Figure 8:
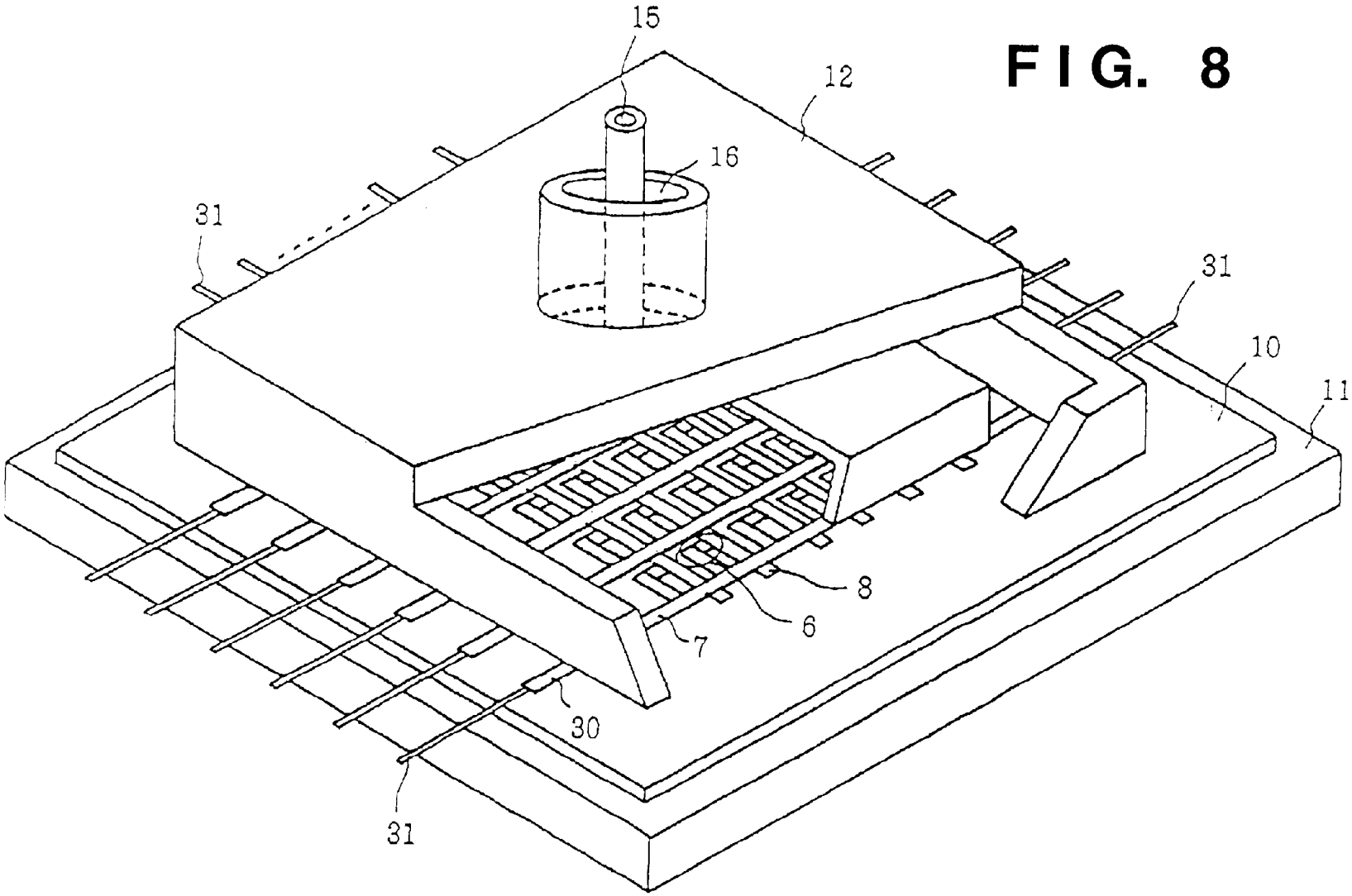
FIG. 8 is a perspective view showing the peripheral portion of an electron source substrate in FIG. 7.

The fabricated electron source substrate 10 shown in FIG. 25 was fixed to a support 11 of the manufacturing apparatus shown in FIGS. 7 and 8. A stainless steel vessel 12 was set on the electron source substrate 10 as shown in FIG. 8 so as to set extracted wiring lines 30 outside the vacuum vessel 12 via a silicone rubber sealing member 18. A metal plate having openings 33 was set as a diffusion plate 19 above the electron source substrate 10. The openings 33 of the diffusion plate 19 were formed to satisfy the following equation at an interval of 5 mm in the concentric direction and an interval of 5° in the circumferential direction with an opening at the center (intersection of a line extended from the center of the gas inlet port and the diffusion plate) that had a circular shape 1 mm in diameter. A distance L from the distance from the center of the gas inlet port to the intersection of the line extended from the center of the gas inlet port and the diffusion plate was set to 20 mm.

$$S_d = S_0 \times [1 + (d/L)^2]^{1/2}$$

where d: distance from the intersection of the line extended from the center of the gas inlet port and the diffusion plate L: distance from the center of the gas inlet port to the intersection of the line extended from the center of the gas inlet port and the diffusion plate $S_d$: opening area at the distance d from the intersection of the line extended from the center of the gas inlet port and the diffusion plate $S_0$: opening area at the intersection of the line extended from the center of the gas inlet port and the diffusion plate A valve 25*f* on an exhaust port 16 side was opened to evacuate the interior of the vessel 12 by a vacuum pump 26 (scroll pump in this case) to about $1\times10^{-1}$ Pa. Thereafter, a voltage was applied between the device electrodes 2 and 3 of each electron-emitting device 6 via the X-direction wiring line 7 and Y-direction wiring line 8 using a driver 32. Thus, forming processing was performed for a conductive film 4 to form a gap G shown in FIG. 23 in the conductive film 4.

Activation processing was done using the same apparatus. In activation processing, gas supply valves 25*a* to 25*d* shown in FIG. 7 and a valve 25*e* on a gas inlet port 15 side were opened to introduce a gas mixture of an organic substance gas 21 and carrier gas 22 into the vacuum vessel 12. The organic substance gas 21 was 1% ethylene-mixed nitrogen gas, and the carrier gas 22 was nitrogen gas. Their flow rates were 40 sccm and 400 sccm, respectively. While the pressure of a vacuum gauge 27 on the exhaust port 16 side was checked, the opening/closing degree of the valve 25*f* was adjusted to set the internal pressure of the vessel 12 to $1.3\times10^4$ Pa.

Activation processing was done by applying a voltage between the device electrodes 2 and 3 of each electron-emitting device 6 via the X-direction wiring line 7 and Y-direction wiring line 8 using the driver 32. The voltage was 17 V, the pulse width was 1 msec, the frequency was 100 Hz, and the activation time was 30 min. Activation was performed by a method of commonly connecting all the Y-direction wiring lines 8 and unselected lines of the X-direction wiring lines 7 to Gnd (ground potential), selecting 10 lines of the X-direction wiring lines 7, and sequentially applying a 1-msec pulse voltage in units of lines. This method was repeated to perform activation processing for all the X-direction lines.

Carbon films 29 were formed via a gap 5 on the electron-emitting device having undergone activation processing, as shown in FIGS. 22 and 23.

The device current If (current flowing between the device electrodes of the electron-emitting device) at the end of activation processing was measured for each X-direction wiring line to find that variations of the device current If were about 5%. Sufficient activation processing could be performed.

In activation processing, a mass spectrometer (not shown) with a differential exhaust device was used to analyze gas on the exhaust port 16 side to find that mass No. 28 of nitrogen and ethylene and mass No. 26 of an ethylene fragment instantaneously increased to be saturated, and the two values were constant during activation processing.

In this example, the gas mixture containing the organic substance was introduced into the vessel 12 set on the electron source substrate 10 at a pressure of $1.3\times10^4$ Pa falling within the viscous flow region, so that the organic substance concentration in the vessel 12 could be made uniform within a short period. Therefore, the time required for the activation processing step could be greatly shortened.

Example 11

In this example, an electron source substrate 10 fabricated similarly to Example 10 up to steps before activation processing was used and set in the manufacturing apparatus in FIG. 7.

In this example, a gas mixture containing an organic substance was heated to 120° C. by a heater arranged around a pipe 28, and then introduced into a vessel 12. The electron source substrate 10 was heated using a heater 20 inside a support 11 to set the substrate temperature to 120° C. Except for this, activation processing was executed similarly to Example 1.

Carbon films 29 were formed via a gap 5 on an electron-emitting device having undergone activation processing, as shown in FIGS. 22 and 23.

Similar to Example 10, this example could perform activation within a short time. The device current If (current flowing between the device electrodes of the electron-emitting device) at the end of activation processing was measured for each X-direction wiring line to find that the device current If increased about 1.2 times, compared to Example 1. Variations of the device current If were about 4%, and activation excellent in uniformity could be done.

Example 12

Figure 9:
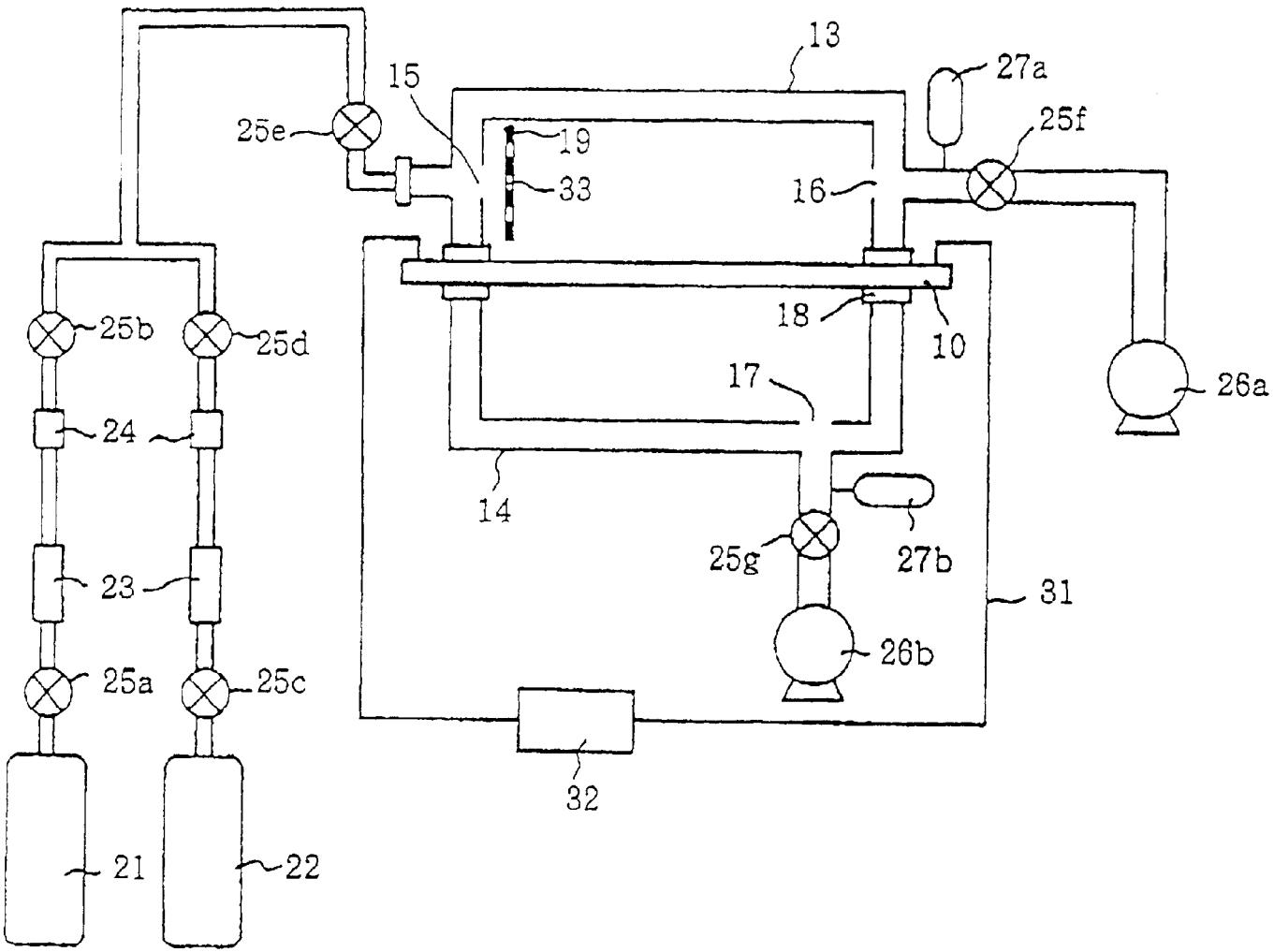
FIG. 9 is a sectional view showing another example of the electron source manufacturing apparatus according to the present invention.

In this example, an electron source substrate 10 shown in FIG. 25 that was fabricated up to the step of forming a conductive film 4 similarly to Example 10 was set between a first vessel 13 and second vessel 14 of the manufacturing apparatus shown in FIG. 9 via a silicone rubber sealing member 18. This example executed activation processing without setting any diffusion plate 19.

A valve 25*f* on an exhaust port 16 side of the first vessel 13 and a valve 25*g* on an exhaust port 17 side of the second vessel 14 were opened to evacuate the interiors of the first vessel 13 and second vessel 14 to about $1\times10^{-1}$ Pa by vacuum pumps 26*a* and 26*b* (scroll pumps in this case). Similar to Example 1, a voltage was applied between electrodes 2 and 3 of each electron-emitting device 6 via an X-direction wiring line 7 and Y-direction wiring line 8 using a driver 32 to perform forming processing for the conductive film 4, thereby forming a gap G shown in FIG. 23 in the conductive film 4.

Activation processing was done using the same apparatus. In the activation processing step, gas supply valves 25*a* to 25*d* and a valve 25*e* on the gas inlet port 15 side shown in FIG. 9 were opened to introduce a gas mixture of an organic substance gas 21 and carrier gas 22 into the first vessel 13. The organic gas 21 was 1% propylene-mixed nitrogen gas, and the carrier gas 22 was nitrogen gas. Their flow rates were 10 sccm and 400 sccm, respectively. After these gases were passed through corresponding dehumidifying filters 23, the gas mixture was introduced into the first vessel 13. While the pressure of a vacuum gauge 27*a* on the exhaust port 16 side was checked, the opening degree of the valve 25*f* was adjusted to set the internal pressure of the first vessel 13 to $2.6\times10^4$ Pa.

At the same time, the opening degree of the valve 25*g* on the exhaust port 17 side of the second vessel 14 was adjusted to set the internal pressure of the second vessel 14 to $2.6\times10^4$ Pa.

Similar to Example 10, a voltage was applied between the device electrodes 2 and 3 of each electron-emitting device 6 via the X-direction wiring line 7 and Y-direction wiring line 8 using the driver 32 to perform activation processing Carbon films 29 were formed via a gap 5 on the electron-emitting device having undergone activation processing, as shown in FIGS. 22 and 23.

The device current If (current flowing between the device electrodes of the electron-emitting device) at the end of activation processing was measured for each X-direction wiring line to find that variations of the device current If were about 8%.

In activation processing, a mass spectrometer (not shown) with a differential exhaust device was used to analyze gas on the exhaust port 16 side to find that mass No. 28 of nitrogen and mass No. 42 of propylene instantaneously increased to be saturated, and the two values were constant during the activation processing step.

In this example, the gas mixture containing the organic substance was introduced into the first vessel 13 set on the electron source substrate 10 having electron-emitting devices at a pressure of $2.6\times10^4$ Pa falling within the viscous flow region, and thus the organic substance concentration in the vessel could be made uniform within a short period. Hence, the time required for activation could be greatly shortened.

Example 13

An electron source substrate 10 formed up to activation processing similarly to Example 12 was used and set in the manufacturing apparatus of FIG. 9. In Example 13, activation processing was performed similarly to Example 12 except that a diffusion plate 19 as shown in FIGS. 10A and 10B was set in a vessel 13.

Also in this example, carbon films 29 were formed via a gap 5 on an electron-emitting device having undergone activation processing, as shown in FIGS. 22 and 23.

Openings 33 of the diffusion plate 19 were formed to satisfy the following equation at an interval of 5 mm in the concentric direction and an interval of 5° in the circumferential direction with an opening at the center (intersection of a line extended from the center of the gas inlet port and the diffusion plate) that had a circular shape 1 mm in diameter. A distance L from the distance from the center of the gas inlet port to the intersection of the line extended from the center of the gas inlet port and the diffusion plate was set to 20 mm.

$$S_d=S_0\times[1+(d/L)^2]^{1/2}$$

where d: distance from the intersection of the line extended from the center of the gas inlet port and the diffusion plate L: distance from the center of the gas inlet port to the intersection of the line extended from the center of the gas inlet port and the diffusion plate $S_d$: opening area at the distance d from the intersection of the line extended from the center of the gas inlet port and the diffusion plate $S_0$: opening area at the intersection of the line extended from the center of the gas inlet port and the diffusion plate Also in this example, similar to Example 12, activation could be done within a short time. The device current If (current flowing between the device electrodes of the electron-emitting device) at the end of activation was measured for each X-direction wiring line to find that variations of the device current If were about 5%. Activation processing excellent in uniformity could be done.

Example 14

In Example 14, an image forming apparatus shown in a drawing was fabricated using an electron source formed by the present invention.

Similar to Example 11, an electron source substrate 10 having undergone forming processing and activation processing was fixed to a rear plate 61, as shown in FIG. 21. Then, a face plate 66 was arranged 5 mm above the substrate via a support frame 62 and an exhaust pipe (not shown). The resultant structure was sealed using frit glass in an argon atmosphere at 420° C. After the interior of the container was evacuated, the exhaust pipe was sealed to fabricate the display panel of an image forming apparatus as shown in FIG. 21.

Finally, to maintain the pressure after sealing, getter processing was executed by a high-frequency heating method.

The display panel completed in this fashion was connected to a necessary driving means to constitute an image forming apparatus. Electrons were emitted by applying scan signals and modulation signals from signal generation means (not shown) to respective electron-emitting devices via outer container terminals Dx1 to Dxm and Dy1 to Dyn. A high voltage of 5 kV was applied to a metal back 65 or a transparent electrode (not shown) via a high-voltage terminal 67 to accelerate the electron beam and collide it against a fluorescent film 64. The fluorescent film 64 was excited and emitted light to display an image.

The image forming apparatus according to this example could display an image with sufficient quality as a television without any luminance variation and color nonuniformity by visual check.

According to the manufacturing apparatuses of Examples 10 to 14, the organic substance introduction time in the activation step can be shortened to shorten the manufacturing time. A high-vacuum exhaust device can be eliminated to reduce the apparatus manufacturing cost.

Since such manufacturing apparatus suffices to have a vessel which covers only electron-emitting devices on an electron source substrate, the apparatus can be downsized. Since the extracted wiring lines of the electron source substrate are outside the vessel, the electron source substrate and driver can be easily electrically connected.

Using this manufacturing apparatus can provide an electron source and image forming apparatus excellent in uniformity.

Example 15

An image forming apparatus having an electron source on which a plurality of surface-conduction type electron-emitting devices shown in FIG. 24 were wired in a matrix was fabricated. The fabricated electron source substrate had 640 pixels in the X direction and 480 pixels in the Y directions that were arranged in a simple matrix. Fluorescent substances were arranged at positions corresponding to the respective pixels, thereby obtaining an image forming apparatus capable of color display. The surface-conduction type electron-emitting device in this example was fabricated by performing forming processing and activation processing for a conductive film made of PdO fine particles, similar to the above examples.

Figure 11:
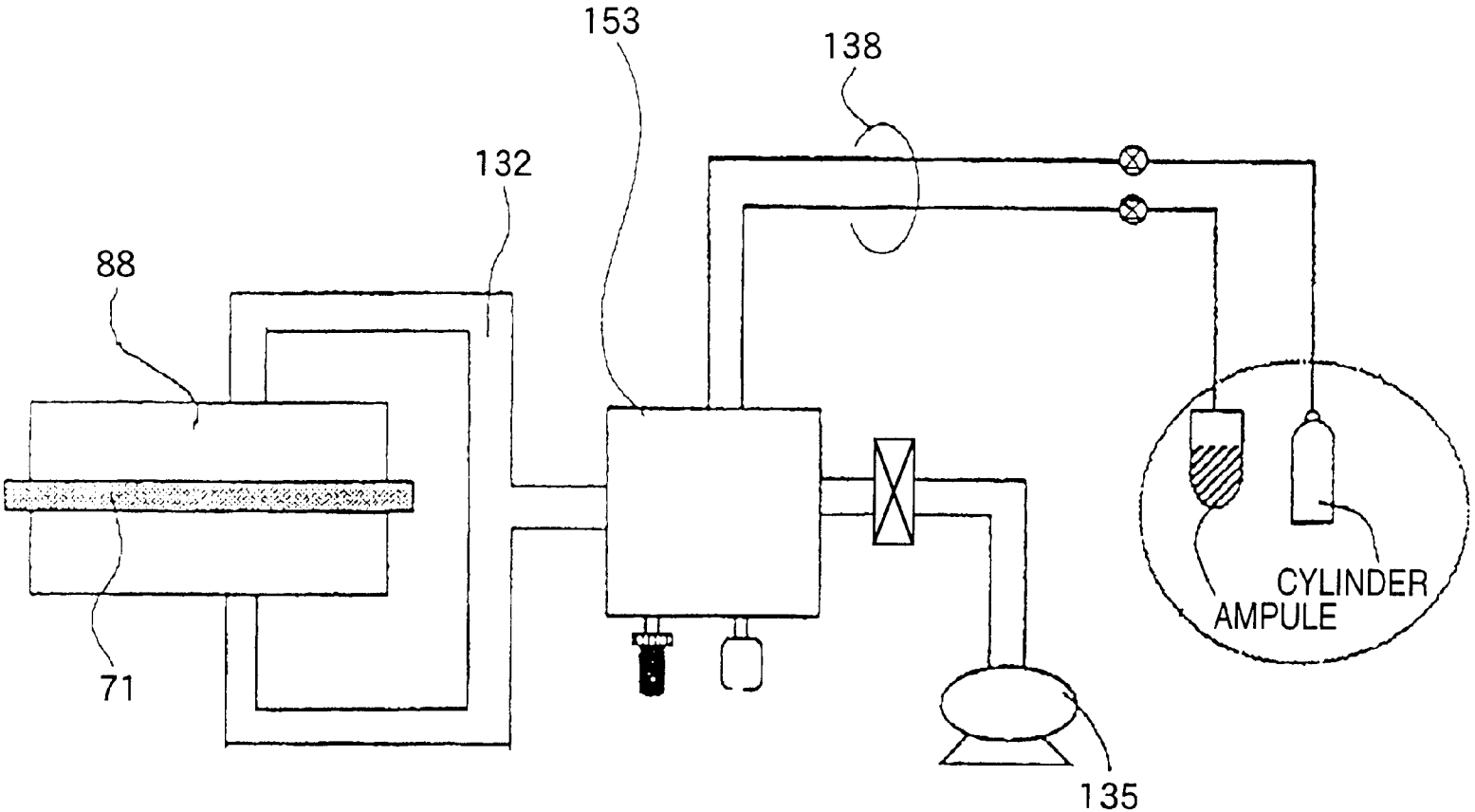
FIG. 11 is a schematic view showing an evacuation device for performing the forming and activation steps for an electron source substrate according to the present invention.
Figure 12:
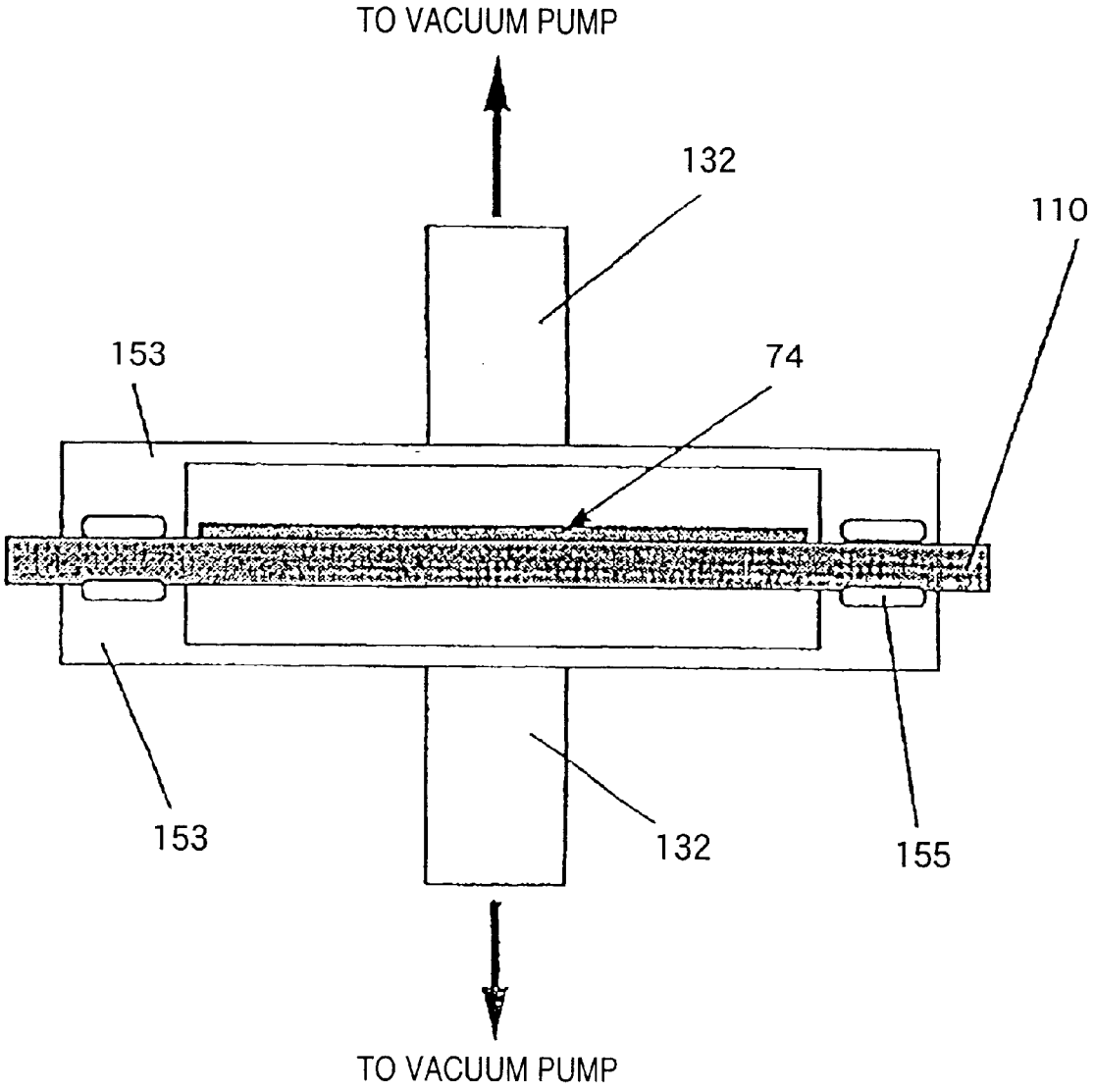
FIG. 12 is a sectional view showing still another example of the manufacturing apparatus according to the present invention.

By the same method as described in the above examples, the electron substrate having the matrix arrangement was connected to an exhaust device 135 shown in FIGS. 11 and 12. Evacuation was done to a pressure of $1\times10^{-5}$ Pa to form a gap G shown in FIG. 23 in a conductive film 4. Upon completion of forming processing, acetone was introduced from a gas inlet line 138. Similar to forming processing, a voltage was applied to each line to execute activation processing. Carbon films 4 were formed via a gap 5, as shown in FIGS. 22 and 23 to fabricate an electron source substrate. After that, appropriate voltages were applied to X-direction electrodes and Y-direction electrodes, and current values flowing through the 640×480 devices were measured to find that five devices did not flow any current. At these defective portions, PdO conductive films were formed again, and the forming processing and activation processing steps were similarly performed. The defective portions were recovered, and the 640×480 electron-emitting devices could be formed on the electron source substrate without any defect. An obtained electron source substrate 71 was aligned with a glass frame serving as an envelope 88, and a face plate having fluorescent substances. The resultant structure was sealed with low-melting glass, and the panel of an image forming apparatus was completed through the panel assembly evacuation, baking, and sealing steps.

Example 16

Figure 13:
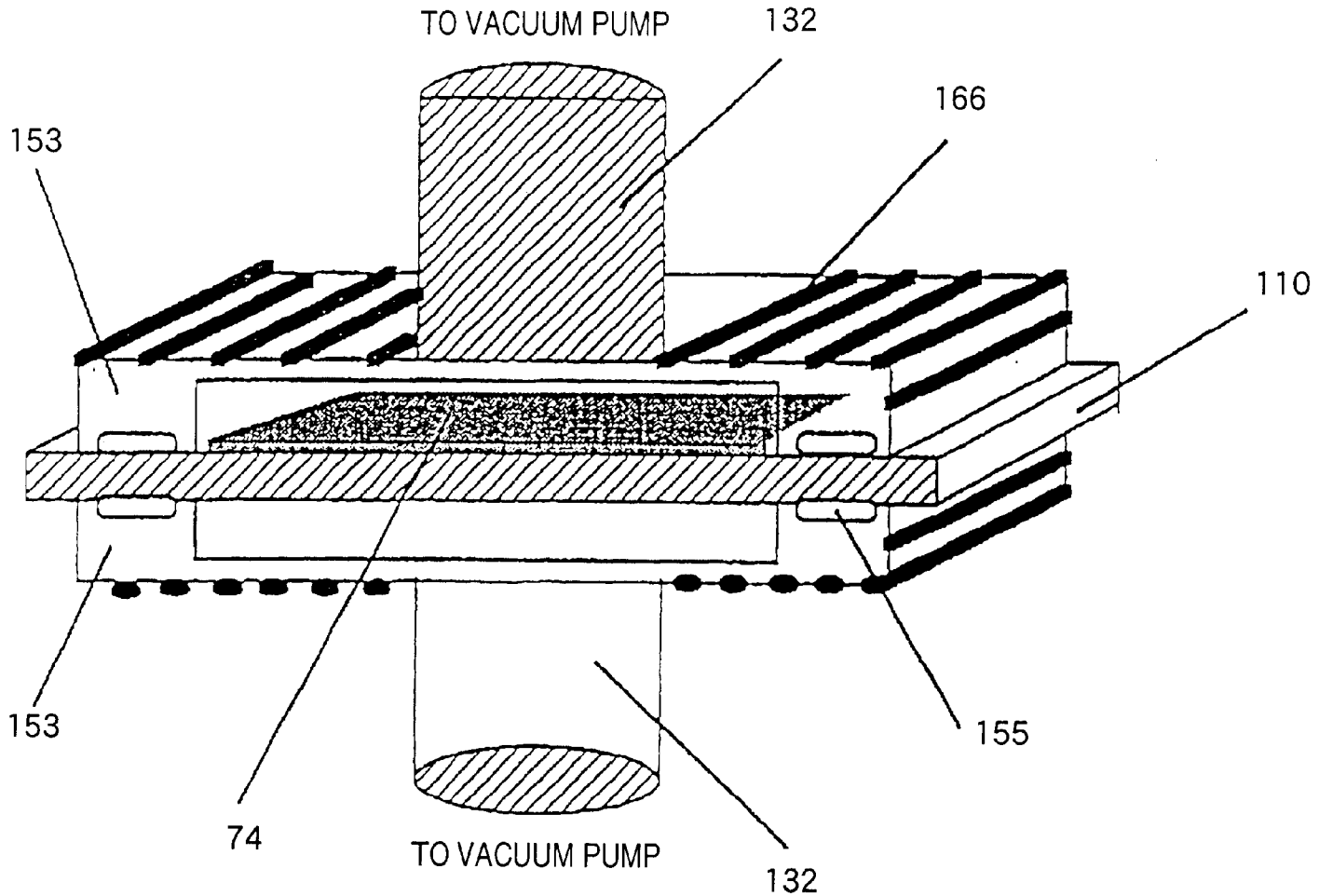
FIG. 13 is a perspective view showing still another example of the manufacturing apparatus according to the present invention.

FIG. 13 shows a schematic view showing a manufacturing apparatus for an image forming apparatus in this example. In FIG. 13, reference numeral 110 denotes a device formation substrate; 74, an electron-emitting device; 153, a vacuum chamber; 132, an exhaust pipe; 155, an O-ring; and 166, a baking heater. Similar to Example 15, the electron source formation substrate having a plurality of surface-conduction type electron-emitting devices wired in a matrix was evacuated to a pressure of $1\times10^{-7}$ Pa from its upper and lower surfaces, and then subjected to forming processing and activation processing. Activation processing was done by sequentially electrifying the devices in a benzonitrile atmosphere at $1\times10^{-4}$ Pa. After activation processing, the vessel and device formation substrate were baked at 250° C. by the baking heater 166 for heating which was arranged in the vacuum chamber 153. The device formation substrate was aligned and sealed with a face plate and support frame, thereby completing the panel of an image forming apparatus.

The manufacturing methods and manufacturing apparatuses according to Examples 15 and 16 described above exhibit the following effects:

(1) Defects of an electron source substrate can be detected before a product envelope containing the electron source substrate is assembled. By repairing the defective portions, an envelope which always surrounds a non-defective electron source substrate can be manufactured.

(2) Since evacuation is done from the upper surface and lower surface of an electron source substrate, a thin glass substrate can be used as an electron source substrate.

Example 17

This example also fabricated an image forming apparatus having an electron source on which surface-conduction type electron-emitting devices shown in FIGS. 22 and 23 were wired in a matrix, as shown in FIG. 24.

This example will be explained.

An ITO film was sputtered to 100 nm on the lower surface of a glass substrate. The ITO film was used as an electrostatic chuck electrode in manufacturing an electron source. The material of the ITO film is not limited as far as its resistivity is $10^9$ Ωcm or less, and a semiconductor, metal, and the like can be used. As shown in FIG. 24, a plurality of row-direction wiring lines 7, a plurality of column-direction wiring lines 8, device electrodes 2 and 3 wired in a matrix by these wiring lines, and PdO conductive films 4 were formed on the upper surface of the glass substrate by the above-mentioned manufacturing method, thereby fabricating a device formation substrate 10. The following steps were performed using the manufacturing apparatus shown in FIG. 14.

Figure 14:
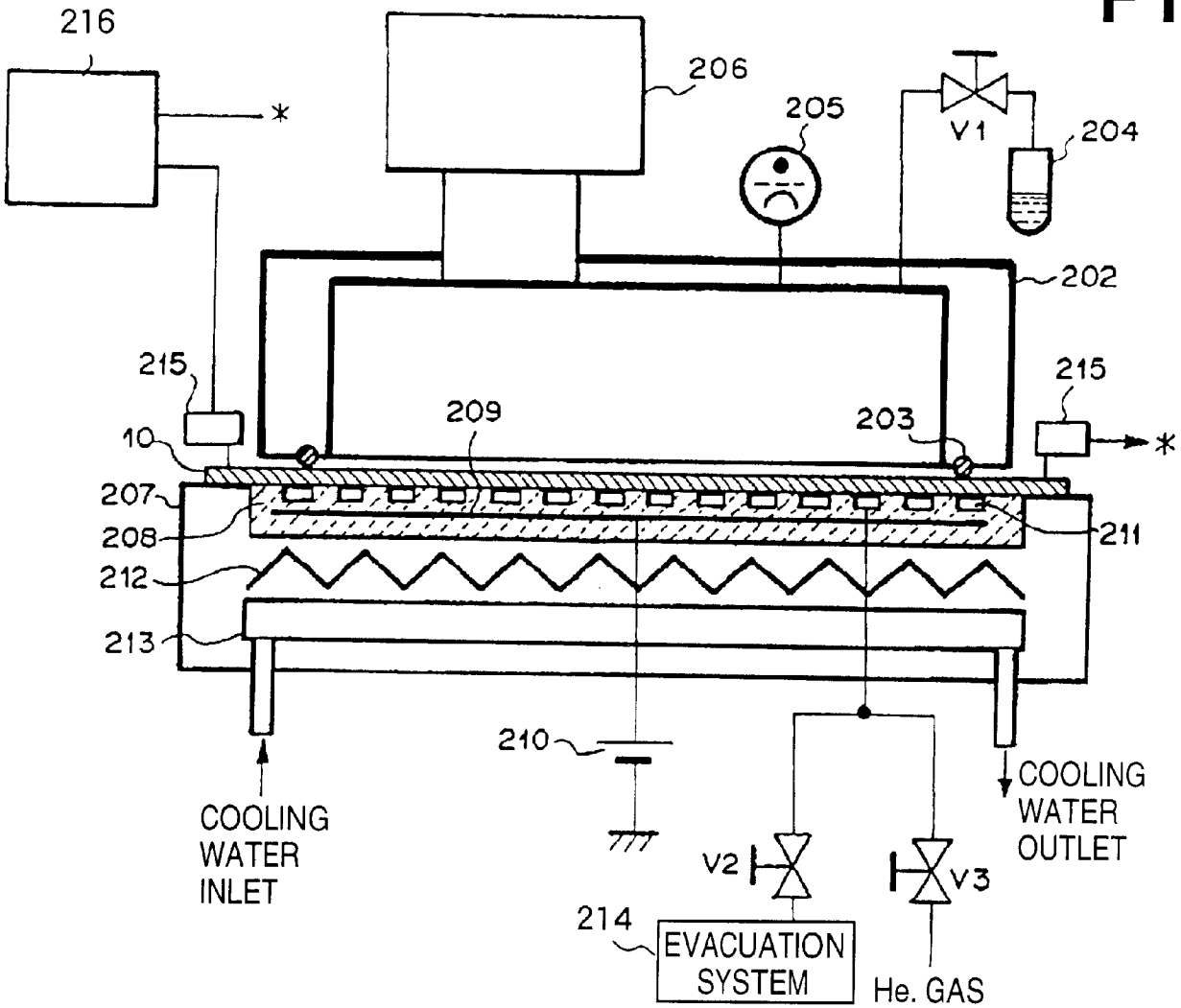
FIG. 14 is a sectional view showing still another example of the manufacturing apparatus according to the present invention.

In FIG. 14, reference numeral 202 denotes a vacuum chamber; 203, an O-ring; 204, benzonitrile as an activation gas; 205, an ionization vacuum gauge as a vacuum gauge;

206, an evacuation system; 207, a substrate holder; 208, an electrostatic chuck set in the substrate holder 207; 209, an electrode buried in the electrostatic chuck 208; 210, a high-voltage power source for applying a DC high voltage to the electrode 209; 211, grooves formed in the surface of the electrostatic chuck 208; 212, an electric heater; 213, a cooling unit; 214, an evacuation system; 215, probe units which can electrically contact part of wiring lines on the device formation substrate 10; and 216, a pulse generator connected to the probe units 215. Reference symbols V1 to V3 denote valves.

The device formation substrate 10 was placed on the substrate holder 207, the valve V2 was opened to evacuate the interior of the groove 211 to 100 Pa or less, and the substrate 10 was vacuum-chucked by the electrostatic chuck 208. At this time, the ITO film on the lower surface of the device formation substrate 10 was grounded to the same potential as the negative pole side of the high-voltage power source 210 via a contact pin (not shown). A DC voltage of 2 kV was supplied from the high-voltage power source 210 (negative pole side was grounded) to the electrode 209, and the device formation substrate 10 was electrostatically chucked by the electrostatic chuck 208. V2 was closed, and V3 was opened to introduce He gas into the groove 211 and keep the He gas at 500 Pa. He gas can improve heat conduction between the device formation substrate 201 and the electrostatic chuck 208. Note that He gas is most suitable, but another gas of $N_2$, Ar, or the like can also be used. The type of gas is not limited as long as desired heat conduction can be attained. The vacuum chamber 202 was mounted on the device formation substrate 10 via the O-ring 203 so as to set the ends of the wiring lines outside the vacuum chamber 202. The airtight space was formed inside the vacuum chamber 202, and evacuated to a pressure of $1\times10^{-5}$ Pa by the evacuation system 206. Cooling water having a water temperature of 15° C. was flowed through the cooling unit 213. Further, power was supplied to the electric heater 212 from a power source (not shown) having a temperature control function, and the device formation substrate 10 was maintained at a predetermined temperature of 50° C.

The probe units 215 were brought into electric contact with the ends of the wiring lines on the device formation substrate 10 that exposed outside the vacuum chamber 202. The pulse generator 216 connected to the probe units 215 applied a triangular pulse having a bottom of 1 msec, a period of 10 msec, and a peak value of 10 V for 120 sec, thereby practicing the forming processing step. Heat generated by a current flowing in forming processing was efficiently absorbed by the electrostatic chuck 208. The device formation substrate 10 was kept at a predetermined temperature of 50° C., satisfactory forming processing could be done, and damage by thermal stress could also be prevented.

By this forming processing, a gap G shown in FIG. 23 was formed in the conductive film 4.

A current flowing through the electric heater 212 was adjusted to maintain the device formation substrate 10 at a predetermined temperature of 60° C. V1 was opened to introduce benzonitrile into the vacuum vessel 202 at a pressure of $2\times10^{-4}$ Pa while the pressure was measured by the ionization vacuum gauge 205. The pulse generator 216 applied via the probe unit 215 a triangular pulse having a bottom of 1 msec, a period of 10 msec, and a peak value of 15 V for 60 min. Similar to the forming processing step, heat generated by a current flowing in activation processing was efficiently absorbed by the electrostatic chuck 208. The device formation substrate 10 was kept at a predetermined temperature of 60° C., activation could be satisfactorily done, and damage by thermal stress could also be prevented.

By this activation processing, carbon films 29 were formed via a gap 5, as shown in FIGS. 22 and 23.

The device formation substrate 10 having undergone these steps was aligned with a glass frame and a face plate having fluorescent substances. The resultant structure was sealed using low-melting glass to fabricate a vacuum envelope. Steps such as the evacuation, baking, and sealing steps were performed in the envelope, thereby fabricating an image forming panel shown in FIG. 21.

Since this example was practiced using the electrostatic chuck 208 and He gas in the forming processing and activation processing steps, high-quality surface-conduction type electron-emitting devices uniform in characteristics could be formed. An image forming panel having high-uniformity image performance could be fabricated. In addition, damage by thermal stress could be prevented to increase the yield.

The present invention can provide an electron source manufacturing apparatus which can be easily downsized and operated.

The present invention can provide an electron source manufacturing method which increases the manufacturing speed and is suitable for mass productivity.

The present invention can provide an electron source manufacturing apparatus and manufacturing method capable of manufacturing an electron source excellent in electron emission characteristics.

Furthermore, the present invention can provide an image forming apparatus excellent in image quality.

What is claimed is:

1. An electron source manufacturing apparatus comprising:

a support member for supporting a substrate having a conductor;

a vessel having a gas inlet port and a gas exhaust port and covering a partial region of a surface of the substrate;

means, connected to the gas inlet port, for introducing gas into said vessel;

means, connected to the gas exhaust port, for evacuating an interior of said vessel; and means for applying a voltage to the conductor.

2. The electron source manufacturing apparatus according to claim 1, wherein the support member comprises means for fixing the substrate to the support member.

3. The electron source manufacturing apparatus according to claim 1, wherein the support member comprises means for vacuum-chucking the substrate and the support member.

4. The electron source manufacturing apparatus according to claim 1, wherein the support member comprises means for electrostatically chucking the substrate and the support member.

5. The electron source manufacturing apparatus according to claim 1, wherein the support member comprises a heat conduction member.

6. The electron source manufacturing apparatus according to any one claims 1, wherein the support member comprises a temperature control mechanism for the substrate.

7. The electron source manufacturing apparatus according to claims 1, wherein the support member comprises heat generation means.

8. The electron source manufacturing apparatus according to claims 1, wherein the support member comprises cooling means.

9. The electron source manufacturing apparatus according to claims 1, wherein said vessel comprises means for diffusing gas introduced into the vessel.

10. The electron source manufacturing apparatus according to claims 1, further comprising means for heating the introduced gas.

11. The electron source manufacturing apparatus according to claims 1, further comprising means for dehumidifying the introduced gas.

12. An electron source manufacturing apparatus, comprising:

a support member for supporting a substrate on which a conductor is formed;

a vessel having a gas inlet port and a gas exhaust port and covering a surface of the substrate except for a part of the conductor;

means, connected to the gas exhaust port, for evacuating an interior of said vessel; and means for contacting the part of the conductor and applying a current to the conductor.

13. The electron source manufacturing apparatus according to claim 12, wherein the support member comprises means for fixing the substrate to the support member.

14. The electron source manufacturing apparatus according to claim 12, wherein the support member comprises means for electrostatically chucking the substrate and the support member.

15. The electron source manufacturing apparatus according to claim 12, wherein the support member comprises a temperature control mechanism for the substrate.

* * * * *

UNITED STATES PATENT AND TRADEMARK OFFICE

CERTIFICATE OF CORRECTION

PATENT NO. : 6,726,520 B2
APPLICATION NO. : 09/788411
DATED : April 27, 2004
INVENTOR(S) : Toshihiko Takeda et al.

It is certified that error appears in the above-identified patent and that said Letters Patent is hereby corrected as shown below:

ON THE TITLE PAGE, ITEM (75)

"Kazuhiro Jindai, Tokyo (JP)" should read --Kazuhiro Jindai, Kanagawa (JP)--.

COLUMN 28

Line 60, "any one claims 1," should read --claim 1,--;
Line 63, "claims 1," should read --claim 1,--; and
Line 66, "claims 1," should read --claim 1,--.

COLUMN 29

Line 2, "claims 1," should read --claim 1,--;
Line 5, "claims 1," should read --claim 1,--; and
Line 8, "claims 1," should read --claim 1,--.

Signed and Sealed this

Sixteenth Day of September, 2008

JON W. DUDAS
*Director of the United States Patent and Trademark Office*